US008831960B2

(12) United States Patent
Shirakawa et al.

(10) Patent No.: US 8,831,960 B2
(45) Date of Patent: Sep. 9, 2014

(54) AUDIO ENCODING DEVICE, AUDIO ENCODING METHOD, AND COMPUTER-READABLE RECORDING MEDIUM STORING AUDIO ENCODING COMPUTER PROGRAM FOR ENCODING AUDIO USING A WEIGHTED RESIDUAL SIGNAL

(75) Inventors: Miyuki Shirakawa, Fukuoka (JP); Yohei Kishi, Kawasaki (JP); Masanao Suzuki, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 254 days.

(21) Appl. No.: 13/546,292

(22) Filed: Jul. 11, 2012

(65) Prior Publication Data

US 2013/0054253 A1 Feb. 28, 2013

(30) Foreign Application Priority Data

Aug. 30, 2011 (JP) ..... 2011-187470

(51) Int. Cl.
*G10L 19/00* (2013.01)
*G10L 21/00* (2013.01)

(52) U.S. Cl.
USPC ..... 704/500; 704/501; 704/503

(58) Field of Classification Search
CPC ..... G10L 19/008
USPC ..... 704/500–504
See application file for complete search history.

(56) References Cited

U.S. PATENT DOCUMENTS 7,283,957 B2 * 10/2007 Minde et al. ..... 704/229
7,394,903 B2 * 7/2008 Herre et al. ..... 381/23
7,646,875 B2 * 1/2010 Schuijers et al. ..... 381/23
7,809,580 B2 * 10/2010 Hotho et al. ..... 704/501
8,260,620 B2 * 9/2012 Ragot et al. ..... 704/500
2008/0195397 A1 * 8/2008 Myburg et al. ..... 704/500
2008/0219344 A1 9/2008 Suzuki et al.
2009/0055194 A1 2/2009 Hotho et al.
2010/0153120 A1 6/2010 Shirakawa et al.

FOREIGN PATENT DOCUMENTS

JP 2007-183528 7/2007
JP 2008-519307 6/2008
JP 2008-224902 9/2008
JP 2010-139671 6/2010

OTHER PUBLICATIONS

"Information technology—MPEG audio technologies—Part 1: MPEG Surround", ISO/IEC 23003-1:2007, Feb. 15, 2007.

(Continued)

*Primary Examiner* — Shaun Roberts
(74) *Attorney, Agent, or Firm* — Staas & Halsey LLP

(57) ABSTRACT

An audio encoding device includes a time-frequency converting unit that conducts time-frequency conversion of channel signals included in an audio signal having a plurality of channels in frame units having a certain length of time to convert the channel signals to respective frequency signals; a downmixing unit that generates a main signal representing a major component of a first channel and a second channel among the plurality of channels, and a residual signal that is a component orthogonal to the main signal; a weight determining unit that obtains a decoding value predicted and a decoding value predicted, obtains signal components affecting each other between the first channel and the second channel; a weighting unit that uses the weighting coefficient; a residual signal encoding unit that encodes the weighted residual signal the weighting coefficient; and a main signal encoding unit that encodes the main signal.

18 Claims, 16 Drawing Sheets

(56) References Cited

OTHER PUBLICATIONS

International Organisation for Standardisation, Coding of Moving Pictures and Audio, ISO/IEC JTC1/SC29/WG11, N7126, Text of ISO/IEC 13818-7:2005 (MPEG-2 AAC 4th edition), pp. i-vi, and pp. 7-181, Apr. 2005.

Third Generation Partnership Project (3GPP) TS 26.403 V9.0.0, "3rd Generation Partnership Project; Technical Specification Group Services and System Aspects; General audio codec audio processing functions; Enhanced aacPlus general audio codec; Encoder specification; Advanced Audio Coding (AAC) part" (Release 9), pp. 1-23, Dec. 2009.

E. Kurniawati et al., "New Implementation Techniques of an Efficient MPEG Advanced Audio Coder", Consumer Electronics, IEEE Transactions, vol. 50, pp. 655-665, 2004.

* cited by examiner

FIG. 7

| idx | 0 | 1 | 2 | 3 | 4 | 5 | 6 | 7 |
|---|---|---|---|---|---|---|---|---|
| ICC[idx] | 1 | 0.937 | 0.84118 | 0.60092 | 0.36764 | 0 | −0.589 | −0.99 |

710 720

700

FIG. 8

| DIFFERENTIAL VALUE | idxicci |
|---|---|
| -7 | 11111111111111 |
| -6 | 11111111111110 |
| -5 | 111111111110 |
| -4 | 1111111110 |
| -3 | 1111110 |
| -2 | 11110 |
| -1 | 110 |
| 0 | 0 |

| DIFFERENTIAL VALUE | idxicc |
|---|---|
| 1 | 10 |
| 2 | 1110 |
| 3 | 111110 |
| 4 | 11111110 |
| 5 | 111111110 |
| 6 | 11111111110 |
| 7 | 1111111111110 |

800

FIG. 9

| I dx | -15 | -14 | -13 | -12 | -11 | -10 | -9 | -8 | -7 | -6 | -5 |
|---|---|---|---|---|---|---|---|---|---|---|---|
| CLD[idx] | -150 | -45 | -40 | -35 | -30 | -25 | -22 | -19 | -16 | -13 | -10 |
| I dx | -4 | -3 | -2 | -1 | 0 | 1 | 2 | 3 | 4 | 5 | 6 |
| CLD[idx] | -8 | -6 | -4 | -2 | 0 | 2 | 4 | 6 | 8 | 10 | 13 |
| I dx | 7 | 8 | 9 | 10 | 11 | 12 | 13 | 14 | 15 | | |
| CLD[idx] | 16 | 19 | 22 | 25 | 30 | 35 | 40 | 45 | 150 | | |

910 920 930 940 950 960 900

AUDIO ENCODING DEVICE, AUDIO ENCODING METHOD, AND COMPUTER-READABLE RECORDING MEDIUM STORING AUDIO ENCODING COMPUTER PROGRAM FOR ENCODING AUDIO USING A WEIGHTED RESIDUAL SIGNAL

CROSS-REFERENCE TO RELATED APPLICATION(S)

This application is based upon and claims the benefit of priority of the prior Japanese Patent Application No. 2011-187470, filed on Aug. 30, 2011, the entire contents of which are incorporated herein by reference.

FIELD

The embodiments discussed herein are related to an audio encoding device that encodes an audio signal having, for example, a plurality of channels, an audio encoding method, and a computer-readable recording medium storing an audio encoding computer program.

BACKGROUND

Encoding systems for encoding an audio signal to compress an amount of audio signal data having a plurality of channels have been developed recently. In particular, there has been proposed an encoding system that improves compression efficiency by encoding signals generated by downmixing signals from a plurality of channels. The parametric stereo system and the MPEG Surround system standardized by the Moving Picture Experts Group (MPEG) are known as such types of encoding systems.

In these encoding systems, spatial information and main signals representing the main components of the original channel signals are generated by downmixing the plurality of channel signals and then encoded. Residual signals representing components that are orthogonal to the main signals are further calculated in these systems and the residual signals are also encoded.

Encoders preferably include encoded data of the residual signals along with encoded data of the main signals in encoded audio signals in order to suppress deterioration of sound quality. On the other hand, to further improve compression efficiency, it is preferable that the residual signals are not included in the encoded audio signals. To satisfy such contradictory requirements, Japanese National Publication of International Patent Application No. 2008-519307, for example, proposes a technique to attenuate time regions or signal portions having little perceptual relation within the residual signals. Thus, attenuation of the residual signals increases as the ratio of the residual signal power with respect to the main signal power decreases. Alternatively, only residual signals having frequencies lower than a specific frequency are selected.

SUMMARY

According to an aspect of the embodiment, an audio encoding device includes a time-frequency converting unit that conducts time-frequency conversion of channel signals included in an audio signal having a plurality of channels in frame units having a certain length of time to convert the channel signals to respective frequency signals; a downmixing unit that generates a main signal representing a major component of a first channel and a second channel among the plurality of channels, and a residual signal that is a component orthogonal to the main signal by downmixing a frequency signal of the first channel and a frequency signal of the second channel; a weight determining unit that obtains a decoding value predicted from the frequency signal of the first channel and a decoding value predicted from the frequency signal of the second channel, obtains signal components affecting each other between the first channel and the second channel in the residual signal based on the decoding value of the first channel and the decoding value of the second channel, and determines a weighting coefficient with respect to the residual signal according to the signal components; a weighting unit that uses the weighting coefficient to add weight to the residual signal; a residual signal encoding unit that encodes the weighted residual signal the weighting coefficient; and a main signal encoding unit that encodes the main signal.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 7 illustrates an example of a quantization table with respect to similarity.

FIG. 8 illustrates an example of a table indicating the relationship between similarity codes and index differential values.

FIG. 9 illustrates an example of a quantization table with respect to an intensity difference.

DESCRIPTION OF EMBODIMENTS

The inventor has uncovered the following knowledge based on new studies. Even if the power of a residual signal is small, reproduced sound quality exhibits noticeable deterioration since the residual signal is not transmitted to the decoding device. For example, when the residual signal is reduced, the decoding device is not able to accurately separate the signals of the original channels from the main signal when decoding the encoded audio signals. Thus, the sound from one channel is mixed with the sound from another channel in the reproduced audio signals. Herein below, the blending of an audio signal of one channel with the audio signal of another channel in the reproduced audio signal will be referred to as "contamination." Moreover, the audio signal of the other channel blended therein will be referred to as a "contaminating signal." For example, it is assumed that an original audio signal contains a channel equivalent to a main sound channel having an audio signal of Japanese conversation and a channel equivalent to a supplemental sound channel having an audio signal of English conversation. In this case, when contamination occurs due to the audio signal being encoded and then decoded, a listener, for example, may hear the Japanese conversation along with the English conversation from the channel equivalent to the main sound channel. In this case, the listener would feel uncomfortable listening to the reproduced an audio signal. The occurrence of contamination of the signals between channels does not depend upon the residual signal power and/or the residual signal frequency. As a result, the abovementioned prior art is not able to suppress the reproduced sound quality deterioration caused by the signal contamination.

Herein below, audio encoding devices according to various embodiments will be discussed with reference to the drawings.

The audio encoding device detects a component that mutually affects a plurality of channels, such as, for example, a component that indicates a contaminating signal, included in a residual signal in each frequency band based on the main signal and spatial information calculated when downmixing signals of the plurality of channels. The audio encoding device increases the code size assigned to the residual signal of a frequency band that includes components in the residual signal that mutually affect the channels, and decreases the code size assigned to the residual signal of a frequency band that does not include such components in the residual signal. As a result, the audio encoding device suppresses the deterioration of reproduced sound quality due to signal contamination and the like while reducing the residual signal code size.

First, an audio encoding device according to a first embodiment will be explained. The audio encoding device according to the first embodiment encodes stereo signals having a left and a right channel.

Figure 1:
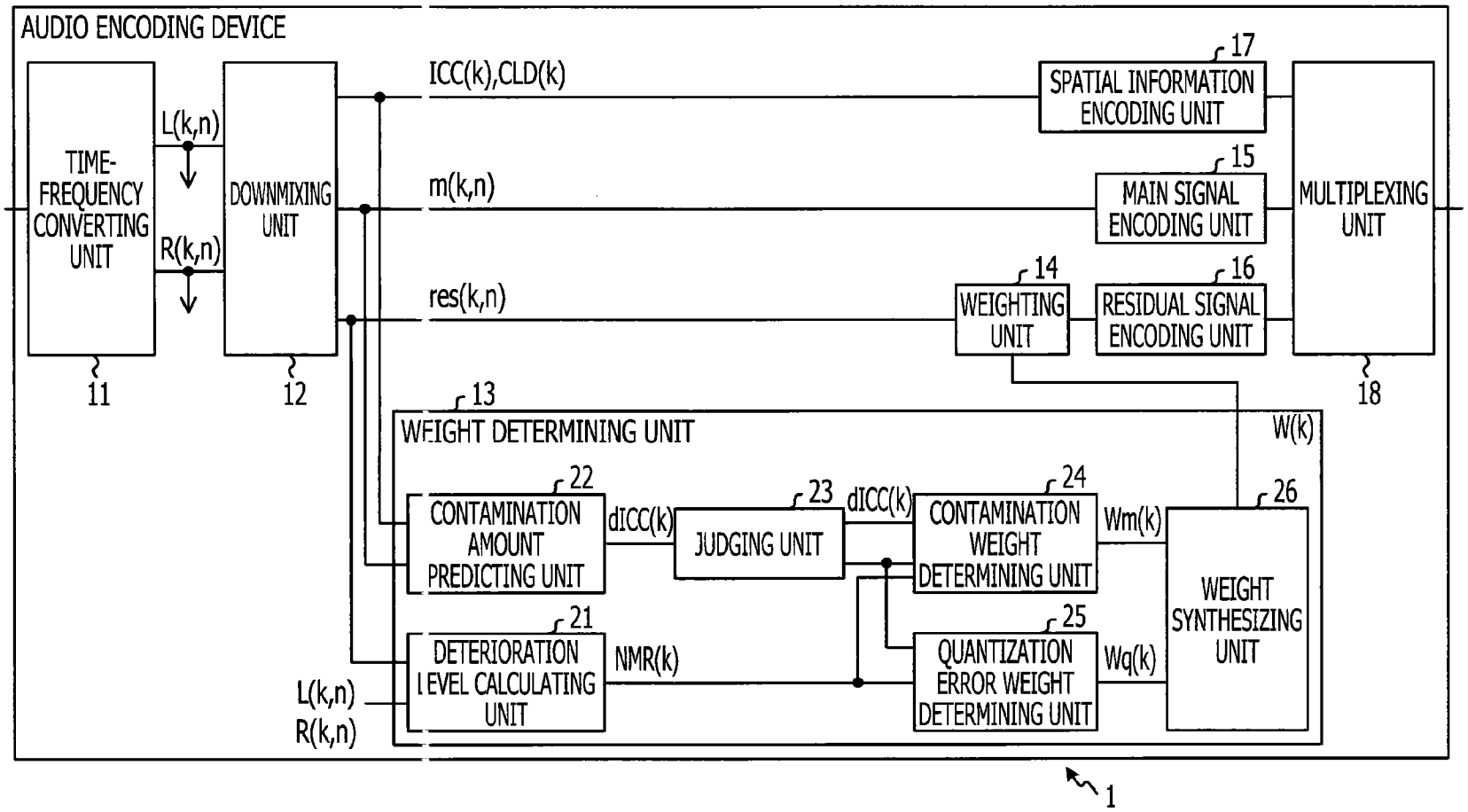
FIG. 1 is a schematic configuration of an audio encoding device according to a first embodiment.

FIG. 1 is a schematic configuration of an audio encoding device 1 according to the first embodiment. As illustrated in FIG. 1, the audio encoding device 1 includes a time frequency converting unit 11, a downmixing unit 12, a weight determining unit 13, a weighting unit 14, a main signal encoding unit 15, a residual signal encoding unit 16, a spatial information encoding unit 17, and a multiplexing unit 18.

Each unit included in the audio encoding device 1 is formed as a separate circuit. Alternatively, each unit included in the audio encoding device 1 may be mounted in the audio encoding device 1 as one integrated circuit that is an integration of the circuits corresponding to the respective units. Furthermore, the respective units included in the audio encoding device 1 may be function modules realized by a computer program executed by a processor included in the audio encoding device 1.

The time frequency converting unit 11 converts channel signals of time regions of a stereo signal inputted into the audio encoding device 1 into frequency signals of each channel by conducting time-frequency conversion of the channel signals into respective frame units.

In the present embodiment, the time frequency converting unit 11 uses a Quadrature Mirror Filter (QMF) filter bank of the following formula to convert the signals of the respective channels into frequency signals.

$$QMF(k, n) = \exp\left[j\frac{\pi}{128}(k + 0.5)(2n + 1)\right], \quad 0 \le k < 64,\ 0 \le n < 128 \tag{1}$$

Here, n is a variable indicating time and represents the nth time slot when equally dividing one frame of the stereo signal of by 128 in the time direction. The frame length may be any length from, for example, 10 to 80 msec. k is a variable that indicates a frequency band and represents the kth frequency band when equally dividing a frequency band of a frequency signal by 64. QMF(k,n) is a QMF for outputting a frequency signal of a time n and a frequency k. The time frequency converting unit 11 generates a channel frequency signal by multiplying the QMF(k,n) by an audio signal of one frame of the input channel.

The time frequency converting unit 11 may also use another time-frequency conversion process such as Fast Fourier Transform, discrete cosine transform, or corrected discrete cosine transform and the like to convert the channel signals to the respective frequency signals.

The time frequency converting unit 11 outputs the channel frequency signals to the downmixing unit 12 and the weight determining unit 13 upon calculating the channel frequency signals in frame units.

The downmixing unit 12 obtains the main signal, the residual signal, and the spatial information upon receiving the left channel and the right channel frequency signals. In the present embodiment, the downmixing unit 12 first derives the spatial information. Specifically, the downmixing unit 12 uses the following formulas to calculate for each frequency band an intensity difference CLD(k) between frequency signals that represents information indicating a sound location, and a similarity ICC(k) between frequency signals that represents information indicating a sound spread.

$$CLD(k) = 10\log_{10}\left(\frac{e_L(k)}{e_R(k)}\right) \tag{2}$$

-continued $$ICC(k) = Re\left\{\frac{e_{LR}(k)}{\sqrt{e_L(k)\cdot e_R(k)}}\right\}$$

$$e_L(k) = \sum_{n=0}^{N-1} |L(k, n)|^2$$

$$e_R(k) = \sum_{n=0}^{N-1} |R(k, n)|^2$$

$$e_L(k) = \sum_{n=0}^{N-1} L(k, n)\cdot R(k, n)$$

Here, N is the number of samples in the time direction included in one frame, N being 128 in the present embodiment. $e_L(k)$ is an auto-correlation value of the left channel frequency signal L(k,n), and $e_R(k)$ is an auto-correlation value of the right channel frequency signal R(k,n). $e_{LR}(k)$ is an cross-correlation value of the left channel frequency signal L(k,n) and the right channel frequency signal R(k,n).

The downmixing unit 12 then uses, for example, the following formula to calculate a coefficient matrix M(CLD(k), ICC(k)) multiplied by the left and right frequency signals L(k,n), R(k,n) based on the spatial information.

$$M(CLD(k), ICC(k)) = \frac{1}{c_1(k)\cos(\alpha+\beta) + c_2(k)\cos(-\alpha+\beta)} \begin{bmatrix} 1 & 1 \\ -c_2(k)\cos(-\alpha+\beta) & c_1(k)\cos(\alpha+\beta) \end{bmatrix} \tag{3}$$

$$c_1(k) = \frac{\sqrt{c(k)^2}}{1+c(k)^2}, \quad c_2(k) = \frac{1}{\sqrt{1+c(k)^2}}$$

$$c(k) = 10^{\frac{CLD(k)}{20}}$$

$$\alpha(k) = \frac{1}{2}\arccos(ICC(k))$$

$$\beta(k) = \arctan\left\{\tan(\alpha(k))\frac{c_2(k)-c_1(k)}{c_2(k)+c_1(k)}\right\}$$

By determining the coefficient matrix M(CLD(k), ICC(k)) in this way, the downmixing unit 12 increases as much as possible the main signal indicating the main components of the left and right channels, and reduces as much as possible the residual signal indicating components orthogonal to the main signal.

The downmixing unit 12 calculates the main signal m(k,n) and the residual signal res(k,n) by multiplying the coefficient matrix M(CLD(k), ICC(k)) by a vector made up of the left and right frequency signals L(k,n) and R(k,n) as illustrated in the following formula.

$$\begin{bmatrix} m(k, n) \\ res(k, n) \end{bmatrix} = M(CLD(k), ICC(k)) \begin{bmatrix} L(k, n) \\ R(k, n) \end{bmatrix} \tag{4}$$

The downmixing unit 12 outputs the main signal to the main signal encoding unit 15. The downmixing unit 12 also outputs the residual signal to the weighting unit 14. The downmixing unit 12 outputs the spatial information to the spatial information encoding unit 17. The downmixing unit 12 outputs the main signal, the residual signal, and the spatial information to the weight determining unit 13.

The weight determining unit 13 decides a weighting coefficient of the frequency bands multiplied by the residual signal for each frame based on the main signal, the residual signal, and the spatial information. The weight determining unit 13 includes a deterioration level calculating unit 21, a contamination amount predicting unit 22, a judging unit 23, a contamination weight determining unit 24, a quantization error weight determining unit 25, and a weight synthesizing unit 26.

The deterioration level calculating unit 21 calculates a deterioration level of a reproduced sound quality when the residual signal is not used in decoding. Thus, the deterioration level calculating unit 21 calculates the deterioration level NMR(k) for each frequency band in each frame according to the following formula.

$$NMR(k) = \sum_{n=0}^{N-1} |res(k, n)|^2 - \text{mask}(k) \tag{5}$$

Here, res(k) represents the power of the residual signal res(k,n) in the frequency band k. mask(k) is a masking threshold that indicates a power that is the lower limit of a sound frequency signal that the listener is able to hear in the frequency band k. The deterioration level calculating unit 21 may consider the masking threshold mask(k), for example, as the minimum audible power in the frequency band k.

Alternatively, the deterioration level calculating unit 21 may calculate the masking threshold mask(k) according to human aural characteristics. In this case, the masking threshold with regard to the frequency band related to the frame subject to encoding correspondingly increases as the spectral power of the same frequency band in the frame before the frame subject to encoding increases, and as the spectral power of the frequency band next to the frame subject to encoding increases.

The deterioration level calculating unit 21 may calculate the masking threshold according to human aural characteristics based on, for example, a threshold (equivalent to masking threshold) calculating process described in C.1.4 Steps in Threshold Calculation of C.1 Psychoacoustic Model in Annex C of the ISO/IEC 13818-7:2005. In this case, the deterioration level calculating unit 21 calculates the masking thresholds of the left and right channels by using the frequency signals of the first and second frames before the frame subject to encoding. The deterioration level calculating unit 21 then considers the masking threshold mask(k) to be the smaller of the left and right channel masking thresholds using formula (5). This is because the residual signal affects both the right and left channels. The deterioration level calculating unit 21 may have a memory circuit to store the frequency signals of the first and second frames before the frame subject to encoding to calculate the masking threshold in this way.

Alternatively, the deterioration level calculating unit 21 may calculate a masking threshold for the left and right channels according to a method described in Third Generation Partnership Project (3GPP) TS 26.403 V9.0.0 5.4.2 Threshold Calculation. In this case, the deterioration level calculating unit 21 calculates the masking threshold, for example, by obtaining a threshold based on a comparison of the spectral power of each frequency band with a signal to noise ratio, and then correcting the obtained threshold with regard to the sound spread and a pre-echo and the like.

Alternatively, the deterioration level calculating unit 21 may calculate the masking thresholds of the right and left channels according to the masking threshold calculation method described in "New Implementation Techniques of an Efficient MPEG Advanced Audio Coder", Consumer Electronics, IEEE Transactions, 2004, vol. 50 pp. 655-665 by E. Kurniawati, et al. In this case as well, the deterioration level calculating unit 21 considers the masking threshold mask(k) to be the smaller of the left and right channel masking thresholds using formula (5).

The deterioration level calculating unit 21 outputs the deterioration level NMR(k) of each frequency band to the contamination weight determining unit 24 and the quantization error weight determining unit 25.

The contamination amount predicting unit 22 predicts an amount of contaminating signals included in the residual signals for each frequency band.

When contamination from one channel to another channel occurs in an audio signal reproduced from an encoded audio signal, the same sounds are included in both the channels. As the amount of contaminating signals becomes larger, the sounds of the two channels become more similar. Therefore, the similarity between the two channels of the reproduced audio signal becomes higher than the similarity of the two channels of the original audio signal as the amount of contaminating signals increases.

Figure 2:
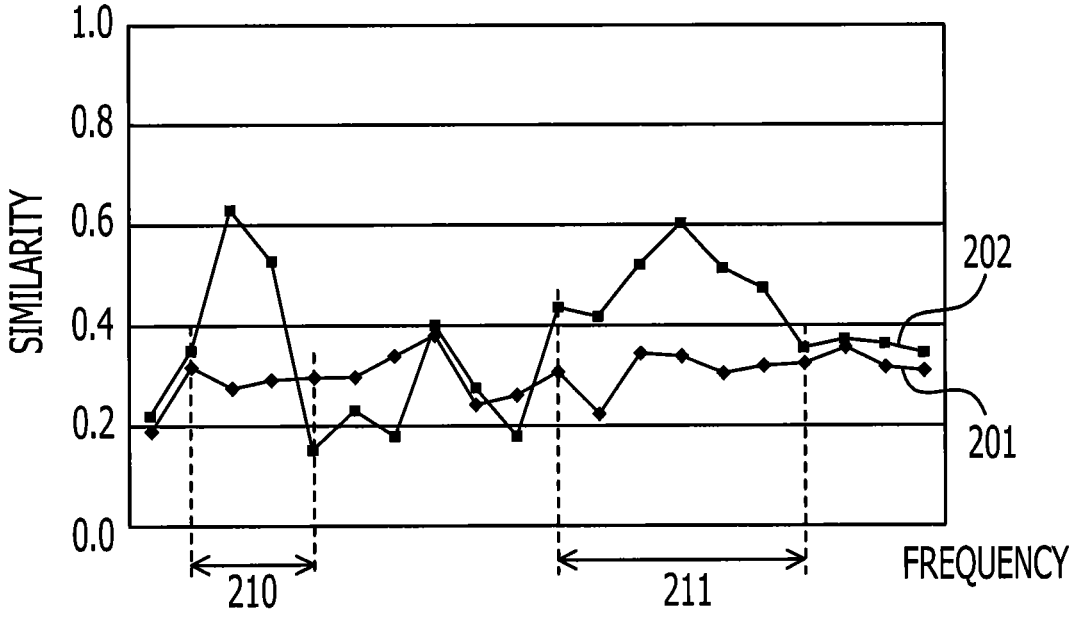
FIG. 2 illustrates an example of a relationship between similarities before and after encoding.

FIG. 2 illustrates an example of a relationship between similarities before and after encoding. In FIG. 2, the horizontal axis indicates frequency and the vertical axis indicates the similarity. Graph line 201 represents the similarity ICC(k) between two channels of the audio signal before encoding, and graph line 202 represents the similarity ICC'(k) between two channels of the audio signal reproduced from the encoded audio signal, namely the audio signal after encoding. In this example, the post-encoding similarity ICC'(k) is larger than the pre-encoding similarity ICC(k) in a frequency band 210 and a frequency band 211. Therefore, it can be seen that contamination occurs in the frequency bands 210 and 211.

The contamination amount predicting unit 22 then reproduces the frequency signals of the left and right channels from the main signal and the spatial information to calculate the reproduced similarity ICC'(k) between the left and right channels. The contamination amount predicting unit 22 derives a differential value dICC(k){=ICC'(k)-ICC(k)} by subtracting the original similarity ICC(k) from the reproduced similarity ICC(k) between the left and right channels, and then uses the value dICC(k) as a contaminating signal prediction amount. Therefore, a frequency band having a contamination prediction amount dICC(k) with a positive value includes contaminating signals in either of the channels of the reproduced audio signal, and the contaminating signal amount is predicted to increase as the prediction amount dICC(k) increases.

The contamination amount predicting unit 22 may predict decoded frequency signals of the left and right channels according to, for example, the decoded sound prediction method described in section 6.5.3.2 of ISO/IEC23003-1, or according to the decoded sound prediction method disclosed in Japanese Laid-Open Patent Publication No. 2010-139671. For example, the contamination amount predicting unit 22 generates a pseudo residual signal by orthogonalizing with respect to the main signal a signal in which a certain delay is added to the main signal. The contamination amount predicting unit 22 then obtains predicted values L'(k,n) and R'(k,n) of the decoded frequency signal of the left and right channels by multiplying the coefficient matrix calculated from the spatial information CLD(k) and ICC(k) as described in section 6.5.3.2 of ISO/IEC23003-1 by a vector made up of the main signal and the pseudo residual signal. The coefficient matrix may be calculated by deriving an inverse matrix of the coefficient matrix M(CLD(k),ICC(k)) depicted in formula (3).

Moreover, the contamination amount predicting unit 22 may calculate the similarity ICC'(k) between the decoded left and right channels by substituting frequency signals L'(k,n) and R'(k,n) for frequency signals L(k,n) and R(k,n) in formula (2).

According to an alternative embodiment, the contamination amount predicting unit 22 may derive a predicted value of the decoded frequency signals of the left and right channels based on a main signal encoded by the main signal encoding unit 15 and based on spatial information encoded by the spatial information encoding unit 17. In this case, the contamination amount predicting unit 22 decodes the main signal using a decoding method corresponding to an encoding method of the main signal encoding unit 15 to be described below, and using a decoding method corresponding to an encoding method of the spatial information encoding unit 17 to be described below. The contamination amount predicting unit 22 may derive a predicted value of the decoded frequency signals of the left and right channels using the decoded main signal and spatial information.

The contamination amount predicting unit 22 outputs the prediction amount dICC(k) of the contaminating signal for each frequency band to the judging unit 23.

The judging unit 23 judges whether or not the residual signals for each frequency band include contaminating signals based on the contaminating signal prediction amount dICC(k). As described above in relation to the contamination amount predicting unit 22, the contaminating signal prediction amount dICC(k) has a positive value when contaminating signals are included in either of the channels of the reproduced audio signal. Therefore, the residual signals are predicted to include contaminating signals in frequency bands that have prediction amounts dICC(k) with certain positive values. On the other hand, in frequency bands that have prediction amounts dICC(k) lower than the certain values, another factor that does not depend on mutual effects between the channels, namely a quantization error during encoding, is predicted to affect the reproduced sound quality.

The judging unit 23 judges whether or not the prediction amount dICC(k) of each frequency band is larger than a certain threshold ThdICC. The judging unit 23 then judges that the residual signals include contaminating signals in frequency bands in which the prediction amount dICC(k) is larger than the threshold ThdICC. The threshold ThdICC is set, for example, to any value in a range from zero to one. The judging unit 23 then outputs a judgment result of each frequency band to the contamination weight determining unit 24 and the quantization error weight determining unit 25. The judging unit 23 also outputs the contaminating signal prediction amount dICC(k) to the contamination weight determining unit 24.

The contamination weight determining unit 24 and the quantization error weight determining unit 25 each determine weighting coefficients with respect to the residual signal res(k,n) in each frame for each frequency band. In particular, the contamination weight determining unit 24 determines a weighting coefficient Wm(k) in the frequency bands in which the residual signals are judged to include contaminating signals. The quantization error weight determining unit 25 determines a weighting coefficient Wq(k) in frequency bands in which the residual signals are judged to not include contaminating signals.

If a certain frame has a deterioration level NMR(k) of zero or of a negative value, the residual signal res(k,n) in the frequency band k in each time slot in the certain frame is not be heard by the listener. As a result, the residual signal res(k,n) may not be used when decoding the signals of each channel. Conversely, if a certain frame has a deterioration level NMR (k) of a positive value, the residual signal res(k,n) in the frequency band k is able to be heard by the listener. As the deterioration level NMR(k) increases, the effect on the sense of hearing of the listener by the residual signal res(k,n) also increases. Therefore in this case, the residual signal res(k,n) is desirably used when decoding the channel signals to suppress the deterioration in the reproduced sound quality.

The relationships for each frequency band between the frame average value of the residual signals res(k,n), the deterioration level NMR(k), and the contaminating signal prediction amount dICC(k), and between the set weighting coefficients Wm(k) and Wq(k) will be explained hereinbelow with reference to FIGS. 3A to 3D.

Figure 3A:
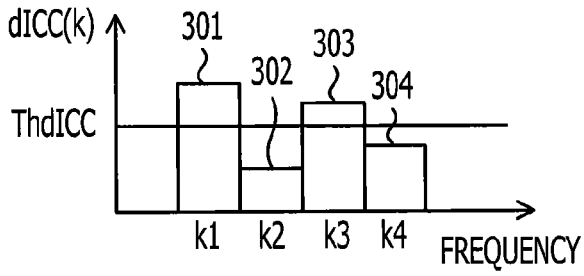
FIG. 3A illustrates an example of a relationship between a threshold and a predicted value of a contaminating signal for each frequency band.

FIG. 3A illustrates an example of a relationship between the threshold ThdICC and the contaminating signal prediction amount dICC(k) for each frequency band. In FIG. 3A, the horizontal axis indicates frequency and the vertical axis indicates the magnitude of the contaminating signal predicted value. The graph bars 301 to 304 represent the contaminating signal prediction amount dICC(k) for respective frequency bands k1 to k4. In this example, the prediction amount dICC (k) in the frequency bands k1 and k3 exceed the threshold ThdICC and thus contaminating signals are included in the residual signals res(k,n) in frequency band k1 and k3. On the other hand, contaminating signal are not included in the residual signals res(k,n) in frequency bands k2 and k4. Therefore, the weighting coefficient Wm(k) corresponding to the residual signals having contaminating signals is set for frequency bands k1 and k3, and the weighting coefficient Wq(k) corresponding to the residual signals not having contaminating signals is set for frequency bands k2 and k4.

Figure 3B:
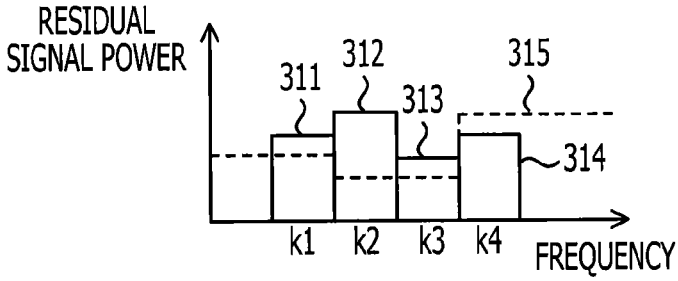
FIG. 3B illustrates an example of a relationship between a masking threshold and a residual signal frame average for each frequency band.

FIG. 3B illustrates an example of the relationship between the masking threshold mask(k) and a power res(k) of the residual signals res(k,n) in each frequency band. In FIG. 3B, the horizontal axis indicates frequency and the vertical axis indicates the residual signal power. The graph bars 311 to 314 respectively represent the power res(k) of the residual signal res(k,n) in the frequency bands k1 to k4. The line 315 represents the masking threshold mask(k) in each frequency band. In this example, since the res(k) is larger than the masking threshold mask(k) in the frequency bands k1 to k3, the residual signals affect the reproduction sound quality in the frequency bands k1 to k3. Since the res(k) is lower than the masking threshold mask(k) in the frequency band k4, the residual signals do not affect the reproduction sound quality in the frequency band k4. As a result, weighting coefficients larger than zero are set only for the frequency bands k1 to k3.

Figure 3C:
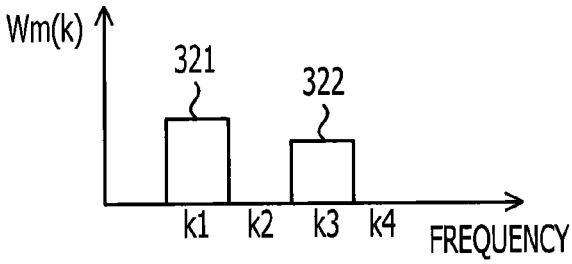
FIG. 3C illustrates an example of a weighting coefficient for each frequency band.

FIG. 3C illustrates an example of the weighting coefficient Wm(k) for each frequency band. In FIG. 3C, the horizontal axis indicates frequency and the vertical axis indicates the magnitude of the weighting coefficient. Graph bars 321 and 322 respectively represent the weighting coefficients Wm(k) in the frequency bands k1 and k3. The weighting coefficient Wm(k) is set as a correspondingly large value in relation to the size of the contaminating signal prediction amount dICC (k) as explained below. As a result, the weighting coefficient Wm(k1) for the frequency band k1 is larger than the weighting coefficient Wm(k3) for the frequency band k3. The weighting coefficients Wm(k) for the frequency bands k2 and k4 are set to zero since the prediction amounts dICC(k) for the frequency bands k2 and k4 are below the threshold ThdICC as illustrated in FIG. 3A.

Figure 3D:
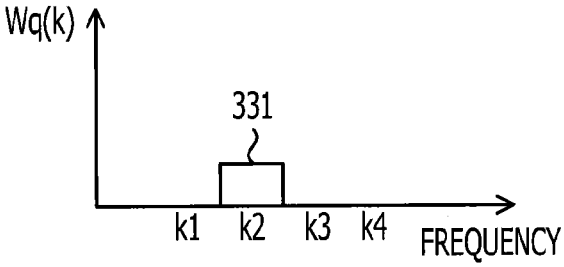
FIG. 3D illustrates an example of a weighting coefficient for each frequency band.

FIG. 3D illustrates an example of the weighting coefficient Wq(k) for each frequency band. In FIG. 3D, the horizontal axis indicates frequency and the vertical axis indicates the magnitude of the weighting coefficient. Graph bar 331 represents the weighting coefficients Wq(k) in the frequency band k2. The weighting coefficient Wq(k) is set as a correspondingly large value in relation to the size of the deterioration level NMR(k) as explained below. The weighting coefficients Wq(k) for the frequency bands k1 and k3 are set to zero since the prediction amounts dICC(k) for the frequency bands k1 and k3 exceed the threshold ThdICC as illustrated in FIG. 3A. The weighting coefficient Wq(k) is also set to zero since the deterioration level NMR(k) is equal to or less than the masking threshold mask(k) in the frequency band k4 as illustrated in FIG. 3B.

The contamination weight determining unit 24 sets the weighting coefficient Wm(k) that is multiplied by the residual signal res(k,n) to zero when the deterioration level NMR(k) in the frequency band k is less than or equal to zero. Conversely, the contamination weight determining unit 24 sets the weighting coefficient Wm(k) to a correspondingly large value as the contaminating signal prediction amount dICC(k) increases when the deterioration level NMR(k) in the frequency band k is greater than zero.

Figure 4:
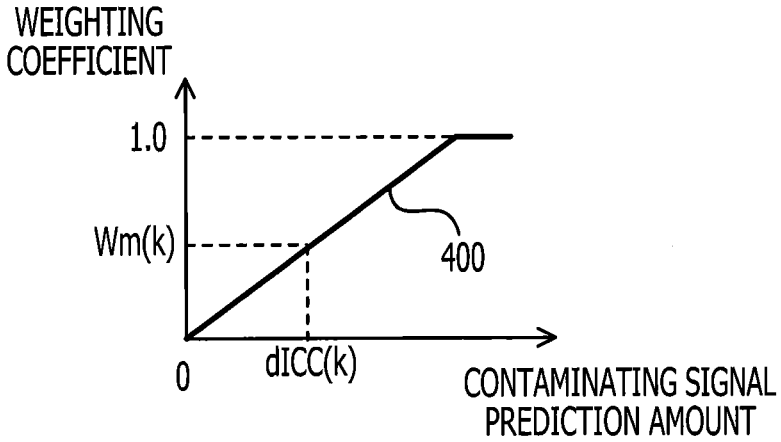
FIG. 4 is a graph indicating an example of the relationship between the weighting coefficient and the predicted value of the contaminating signal.

FIG. 4 is a graph representing an example of the relationship between the weighting coefficient Wm(k) and the contaminating signal prediction amount dICC(k). In FIG. 4, the horizontal axis represents the contaminating signal prediction amount dICC(k) and the vertical axis represents the weighting coefficient Wm(k). A graph line 400 indicates the relationship between the weighting coefficient Wm(k) and the contaminating signal prediction amount dICC(k). As indicated by the graph line 400, the weighting coefficient Wm(k) increases in comparison to the prediction amount dICC(k) until the weighting coefficient Wm(k) reaches 1.0. The weighting coefficient Wm(k) may have a square or linear proportion to the prediction amount dICC(k).

To determine the weighting coefficient Wm(k), the contamination weight determining unit 24 may, for example, previously store a reference table indicating a relationship between the contaminating signal prediction amount dICC(k) and the weighting coefficient Wm(k) in a memory circuit included in the contamination weight determining unit 24. The contamination weight determining unit 24 then specifies the weighting coefficient Wm(k) corresponding to the contaminating signal prediction amount dICC(k) by referring to the reference table when the deterioration level NMR(k) has a positive value.

Furthermore, the contamination weight determining unit 24 may correspondingly increase the weighting coefficient Wm(k) relative to an increase in the deterioration level NMR (k). As a result, the contamination weight determining unit 24 may correct the weighting coefficient Wm(k) to make the weighting coefficient Wm(k) correspondingly larger in relation an increase in the deterioration level NMR(k).

The contamination weight determining unit 24 outputs the weighting coefficient Wm(k) to the weight synthesizing unit 26.

The quantization error weight determining unit 25 determines a weighting coefficient Wq(k) in frequency bands in which the residual signals do not include contaminating signals. The quantization error weight determining unit 25 sets the weighting coefficient Wq(k) that is multiplied with the residual signal res(k,n) to zero when the deterioration level NMR(k) in the frequency band k is less than or equal to zero. The quantization error weight determining unit 25 sets the weighting coefficient Wq(k) to a correspondingly larger value in relation to an increase in the deterioration level NMR(k) when the deterioration level NMR(k) in the frequency band k is greater than zero.

Figure 5:
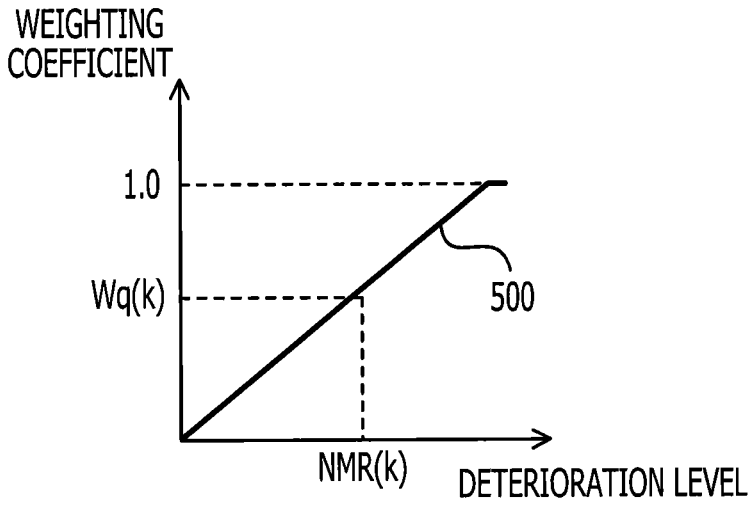
FIG. 5 is a graph indicating an example of the relationship between the weighting coefficient and a deterioration level.

FIG. 5 is a graph indicating an example of the relationship between the weighting coefficient Wq(k) and the deterioration level NMR(k). In FIG. 5, the horizontal axis represents the deterioration level NMR(k) and the vertical axis represents the weighting coefficient Wq(k). The graph line 500 represents an example of the relationship between the weighting coefficient Wq(k) and the deterioration level NMR(k). As indicated by the graph line 500, the weighting coefficient Wm(k) increases in comparison to the deterioration level NMR(k) until the weighting coefficient Wq(k) reaches 1.0. The weighting coefficient Wq(k) may have a square or linear proportion to the deterioration level NMR(k).

To determine the weighting coefficient Wq(k), the quantization error weight determining unit 25 may, for example, previously store a reference table indicating a relationship between the deterioration level NMR(k) and the weighting coefficient Wq(k) in a memory circuit held by the quantization error weight determining unit 25. The quantization error weight determining unit 25 then specifies the weighting coefficient Wq(k) corresponding to the deterioration level NMR (k) by referring to the reference table when the deterioration level NMR(k) has a positive value.

The quantization error weight determining unit 25 outputs the weighting coefficient Wq(k) to the weight synthesizing unit 26.

The weight synthesizing unit 26 synthesizes the weighting coefficients Wm(k) and Wq(k) for each frequency band and obtains a weighting coefficient W(k) for multiplying the result by the residual signal res(k,n). Specifically, the weight synthesizing unit 26 establishes the weighting coefficient W(k) in a frequency band in which the residual signal includes a contaminating signal as Wm(k), and establishes the weighting coefficient W(k) of a frequency band in which the residual signal does not include a contaminating signal as Wq(k). The weight synthesizing unit 26 may also add weights the weighting coefficients Wm(k) and Wq(k) and then synthesize the weighting coefficients to make the weighting coefficient Wm(k) larger than the weighting coefficient Wq(k) with respect to a residual signal at the same level. The weight synthesizing unit 26 may also normalize the weighting coefficient W(k) in each frequency band to the greatest weighting coefficient value so that the greatest weighting coefficient value becomes one.

The weight synthesizing unit 26 outputs the synthesized weighting coefficient W(k) to the weighting unit 14.

Figure 6:
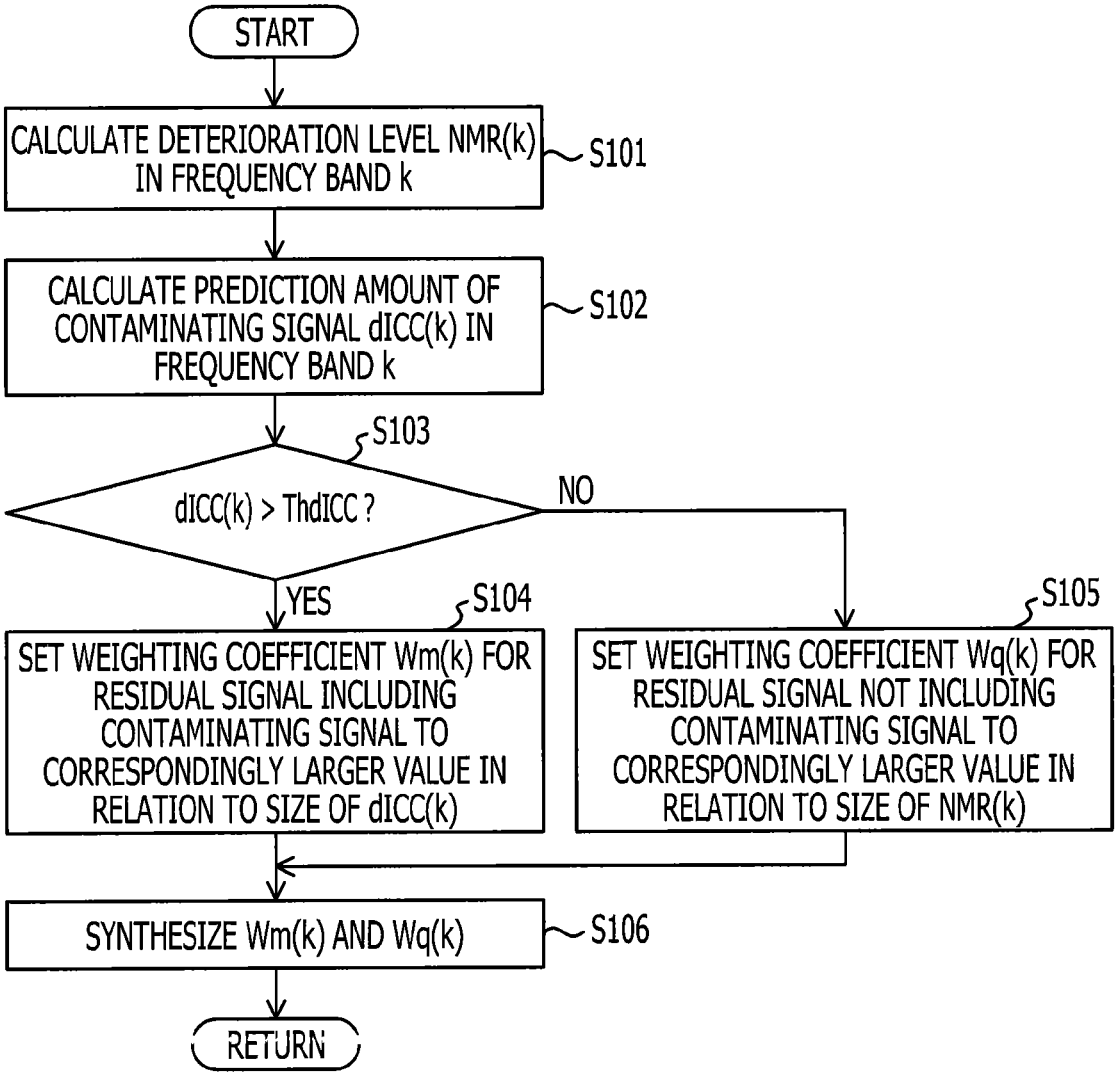
FIG. 6 is a flow chart of residual weighting determination processing.

FIG. 6 is a flow chart of residual weighting determination processing. The flow chart illustrated in FIG. 6 describes processing on one frequency band in one frame. The weight determining unit 13 conducts the residual weighting determination processing illustrated in FIG. 6 in each frequency band.

The deterioration level calculating unit 21 calculates the deterioration level NMR(k) for the frequency band k (step S101). The deterioration level calculating unit 21 outputs the deterioration level NMR(k) to the contamination weight determining unit 24 and the quantization error weight determining unit 25.

The contamination amount predicting unit 22 calculates the prediction amount dICC(k) of the contaminating signal in the frequency band k (step S102). The contamination amount predicting unit 22 outputs the prediction amount dICC(k) to the judging unit 23.

The judging unit 23 judges whether or not the contaminating signal prediction amount dICC(k) is greater than the threshold ThdICC (step S103).

If the dICC(k) is greater than the threshold ThdICC (step S103: Yes), the judging unit 23 judges that the residual signal in the frequency band k includes a contaminating signal. The judging unit 23 outputs the contaminating signal prediction amount dICC(k) to the contamination weight determining unit 24. The contamination weight determining unit 24 sets the weighting coefficient Wm(k) with respect to the residual signal that includes the contaminating signal to a correspondingly larger value in relation to the size of the dICC(k) in the frequency band k (step S104). However, the weighting coefficient Wm(k) may be set to zero if the deterioration level NMR(k) is not greater than zero. The contamination weight determining unit 24 outputs the weighting coefficient Wm(k) to the weight synthesizing unit 26.

If the dICC(k) is equal to or less than the threshold ThdICC (step S103: No), the judging unit 23 judges that the residual signal in the frequency band k does not include a contaminating signal. The judging unit 23 then outputs the judgment result to the quantization error weight determining unit 25. The quantization error weight determining unit 25 sets the weighting coefficient Wq(k) with respect to the residual signal that does not include the contaminating signal to a correspondingly larger value in relation to the size of the NMR(k) (step S105). However, the weighting coefficient Wm(k) may be set to zero if the deterioration level NMR(k) is not greater than zero. The quantization error weight determining unit 25 outputs the weighting coefficient Wq(k) to the weight synthesizing unit 26.

The weight synthesizing unit 26 synthesizes the weighting coefficients Wm(k) and Wq(k) for each frequency band and obtains a weighting coefficient W(k) for multiplying the result by the residual signal res(k,n) (step S106). The weight synthesizing unit 26 outputs the synthesized weighting coefficient W(k) to the weighting unit 14. The weight determining unit 13 then completes the residual weighting determination processing.

According to an alternative embodiment, the weight determining unit 13 may determine the weighting coefficient W(k) based on the contaminating signal prediction amount dICC (k) calculated by the contamination amount predicting unit 22 for only the frequency bands with a positive deterioration level NMR(k) as calculated by the deterioration level calculating unit 21. The weight determining unit 13 then promptly sets the weighting coefficient W(k) to zero for the frequency band in which the NMR(k) is not greater than zero. As a result, the weight determining unit 13 may reduce the amount of computing for calculating the weighting coefficients according to the predicted value of the contamination amount and the amount of computing for predicting the contamination amount, for the frequency band in which the NMR(k) is not greater than zero.

According to another alternative embodiment, the weight determining unit 13 may set the weighting coefficient W(k) to one in the frequency bands in which the residual signals are judged to include contaminating signals without relying on the contaminating signal prediction amount dICC(k). The weight determining unit 13 may also set the weighting coefficient W(k) to zero in frequency bands in which the residual signals are judged to not include contaminating signals without relying on the deterioration level NMR(k). As a result, the weight determining unit 13 may reduce the amount of computing in the processing to determine the weighting coefficient to be multiplied by the residual signal. In this alternative embodiment, the deterioration level calculating unit may be omitted.

The weighting unit 14 multiplies the residual signal res(k, n) by the synthesized weighting coefficient W(k). Specifically, the weighting unit 14 multiplies the weighting coefficient Wm(k) or the weighting coefficient with the added weighting coefficient Wm(k) by the residual signal res(k,n) for frequency bands in which the residual signal res(k,n) includes a contaminating signal. Conversely, the weighting unit 14 multiplies the weighting coefficient Wq(k) or the weighting coefficient with the added weighting coefficient Wq(k) by the residual signal res(k,n) for frequency bands in which the residual signal res(k,n) does not include a contaminating signal.

The weighting unit 14 outputs the weighted residual signal res(k,n) to the residual signal encoding unit 16.

The main signal encoding unit 15 encodes the main signal for each frame. The main signal encoding unit 15 encodes the main signals according to the Advanced Audio Coding (AAC) encoding system for example. In this case, the main signal encoding unit 15 uses, for example, the technique disclosed in Japanese Laid-Open Patent Publication No. 2007-183528. Specifically, the main signal encoding unit 15 calculates a Perceptual Entropy (PE) value. The PE value has characteristics that increase with respect to a sound in which the signal level changes in a short time such as an attack sound made from a percussion instrument. The main signal encoding unit 15 shortens a window for a frame having a comparatively large PE value, and lengthens a window for a block with a comparatively small PE value. For example, a short window includes 256 samples, while a long window includes 2048 samples. The main signal encoding unit 15 frequency-time converts the main signal once by using an inverse conversion of the time-frequency conversion used by the time frequency converting unit 11. The main signal encoding unit 15 then converts the main signal to Modified Discrete Cosine Transform (MDCT) coefficient pairs by conducting MDCT on a signal of a time region converted from the main signal using a window of a determined length. The main signal encoding unit 15 quantizes the MDCT coefficient pairs to conduct entropy encoding of the quantized MDCT coefficient pairs.

Moreover, the main signal encoding unit 15 may encode a high-frequency component, which is a component included in a high-frequency band, in the main signal according to the Spectral Band Replication (SBR) encoding system. In this case, the main signal encoding unit 15 conducts the above-mentioned AAC encoding on a low-frequency component that is included in a low frequency band and is obtained by conducting low-pass filter processing on the main signal. On the other hand, the main signal encoding unit 15 removes the low-frequency component from the main signal and conducts SBR encoding on the high-frequency component.

For example, the main signal encoding unit 15 replicates the low-frequency component that has a strong correlation with the high-frequency component subject to SBR encoding as disclosed in Japanese Laid-Open Patent Publication No. 2008-224902. The main signal encoding unit 15 then adjusts the power of the replicated high-frequency component to match the power of the original high-frequency component. The main signal encoding unit 15 considers a component among the original high frequency components that is not able to approximate the high-frequency component to be supplemental information even if the difference between the low-frequency component and the high-frequency component is great and the low-frequency component is replicated. The main signal encoding unit 15 encodes the information indicating the positional relationship of the low-frequency component used for replicating and the corresponding high-frequency component, and the information to supplement the power adjustment amount by quantization.

The main signal encoding unit 15 outputs the encoded data obtained by encoding the main signal to the multiplexing unit 18.

The residual signal encoding unit 16 encodes the weighted residual signal in each frame. The residual signal encoding unit 16 encodes the weighted residual signal using, for example, AAC encoding. Therefore, the MDCT coefficient corresponding to the frequency band in which the weighted residual signal is small is also small. As a result, the MDCT coefficient is quantized and the quantized MDCT coefficient becomes zero or a value close to zero. A code with a short code length is assigned to the quantized MDCT coefficient at zero or close to zero by entropy encoding. Therefore, the code size of the residual signal is reduced in a frequency band having a small weighted residual signal. Conversely, since the MDCT coefficient corresponding to a frequency band having a large weighted residual signal does not become zero, the MDCT coefficient is restored by the decoding device although a quantization error is superimposed in the MDCT coefficient. Therefore, the decoding device is able to use the residual signal for decoding the frequency signal of each channel in the frequency band having the large weighted residual signal.

The residual signal encoding unit 16 outputs the encoded residual signal to the multiplexing unit 18.

The spatial information encoding unit 17 generates a parametric stereo code (hereinbelow, referred to as a PS code) by encoding the spatial information received from the downmixing unit 12.

The spatial information encoding unit 17 refers to a quantization table that indicates a correspondence between a similarity value in the spatial information and an index value. The spatial information encoding unit 17 determines an index value closest to the respective similarity ICC(k) for each frequency band by referring to the quantization table. The quantization table is previously stored in a memory in the spatial information encoding unit 17.

FIG. 7 illustrates an example of a quantization table with respect to similarity. In a quantization table 700 illustrated in FIG. 7, each field in the top row 710 represents an index value, and each field in the bottom row 720 represents a central value of the similarity corresponding to the index value in the same column. The similarity may take values in a range from −0.99 to +1. For example, if the similarity with respect to the frequency band k is 0.6, the central value of the similarity with respect to the index value 3 is the closest similarity with respect to the frequency band k in the quantization table 700. The spatial information encoding unit 17 then sets the index value with respect to the frequency band k to 3.

Next, the spatial information encoding unit 17 derives a differential value between each index along the frequency direction for each frequency band. For example, if the index value of the frequency band k is three and the index value of the frequency band (k−1) is zero, the spatial information encoding unit 17 finds the index differential value of the frequency band k to be three.

The spatial information encoding unit 17 refers to an encoding table that indicates a correspondence between the differential value of the index value and a similarity code. The spatial information encoding unit 17 determines a similarity code idxicc(k) with respect to the differential value between the indexes in each frequency of the degree of similarity ICC(k) by referring to the encoding table. The encoding table is previously stored in a memory in the spatial information encoding unit 17. Moreover, the similarity code may be a variable length code, such as a Huffman code or an arithmetic code, in which the code length decreases in relation to an increase in the appearance frequency of the differential value.

FIG. 8 illustrates an example of a table indicating the relationship between similarity codes and index differential values. In this example, the similarity codes are Huffman codes. In an encoding table 800 illustrated in FIG. 8, the fields of the left column represent the index differential values, and the fields of the right column represent the similarity codes corresponding to the index differential values in the same row. For example, if the index differential value for the similarity ICC(k) of the frequency band k is 3, the spatial information encoding unit 17 refers to the encoding table 800 to set the similarity code idxicc(k) with respect to the similarity ICC(k) of the frequency band k to "111110".

The spatial information encoding unit 17 refers to a quantization table that indicates a correspondence between an intensity difference value and the index value. The spatial information encoding unit 17 determines an index value closest to the intensity difference CLD(k) for each frequency band by referring to the quantization table. The spatial information encoding unit 17 obtains a differential value between indexes along the frequency direction for each frequency band. For example, if the index value of the frequency band k is 2 and the index value of the frequency band (k−1) is 4, the spatial information encoding unit 17 finds the index differential value of the frequency band k to be −2.

FIG. 9 illustrates an example of a quantization table with respect to an intensity difference. In a quantization table 900 illustrated in FIG. 9, fields in the rows 910, 930, and 950 represent index values, and fields in the rows 920, 940, and 960 respectively represent central values for intensity differences corresponding to the index values of the rows 910, 930, and 950 represented in the same columns.

For example, if the intensity difference CLD(k) with respect to the frequency band k is 10.8 dB, the central value of the intensity difference corresponding to the index value 5 is the closest to the CLD(k) in the quantization table 900. The spatial information encoding unit 17 then sets the index value with respect to the CLD(k) to 5.

The spatial information encoding unit 17 refers to an encoding table that indicates a correspondence between the differential value between indexes and an intensity difference code. The spatial information encoding unit 17 determines an intensity difference code idxcld(k) with respect to the differential value between the indexes in adjacent frequency bands by referring to the encoding table. Moreover, similar to the similarity code, the intensity difference code may be a variable length code, such as a Huffman code or an arithmetic code, in which the code length decreases in relation to an increase in the appearance frequency of the differential value.

The quantization table and the encoding table are previously stored in a memory in the spatial information encoding unit 17.

The spatial information encoding unit 17 uses the similarity code idxicc(k) and the intensity difference code idxcld(k) to generate a PS code. For example, the spatial information encoding unit 17 generates the PS code by arranging the similarity code idxicc(k) and the intensity difference code idxcld(k) in a certain order. This certain order is described in, for example, ISO/IEC 23003-1:2007.

The spatial information encoding unit 17 outputs the generated PS code to the multiplexing unit 18.

The multiplexing unit 18 conducts multiplexing by arranging the encoded main signal, residual signal, and spatial information in the certain order. The multiplexing unit 18 then outputs an encoded audio signal generated by the above multiplexing.

Figure 10:
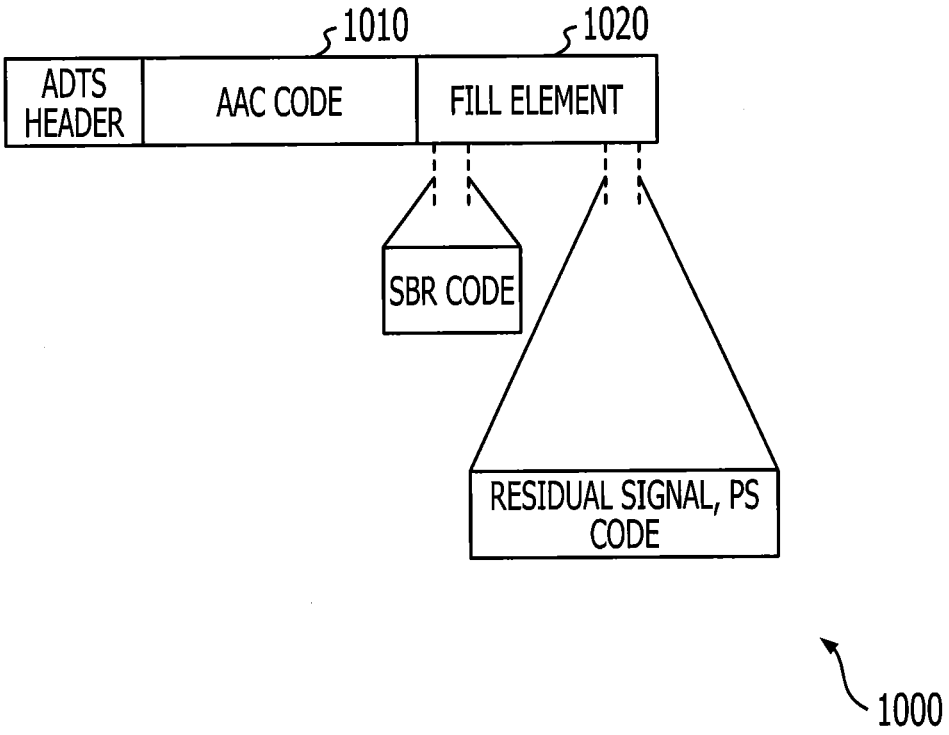
FIG. 10 illustrates an example of a data format stored in an encoded audio signal.

FIG. 10 illustrates an example of a data format stored in an encoded audio signal. In this example, the encoded audio signal is generated according to the MPEG-4 Audio Data Transport Stream (ADTS) format.

An encoded data string 1000 illustrated in FIG. 10 includes in a data block 1010 an AAC code generated by encoding the main signal. Moreover, an SBR code generated by encoding the main signal, and the PS code generated by encoding the encoded residual signal and the spatial information are stored in a portion of a block 1020 stored in an ADTS format FILL element.

Figure 11:
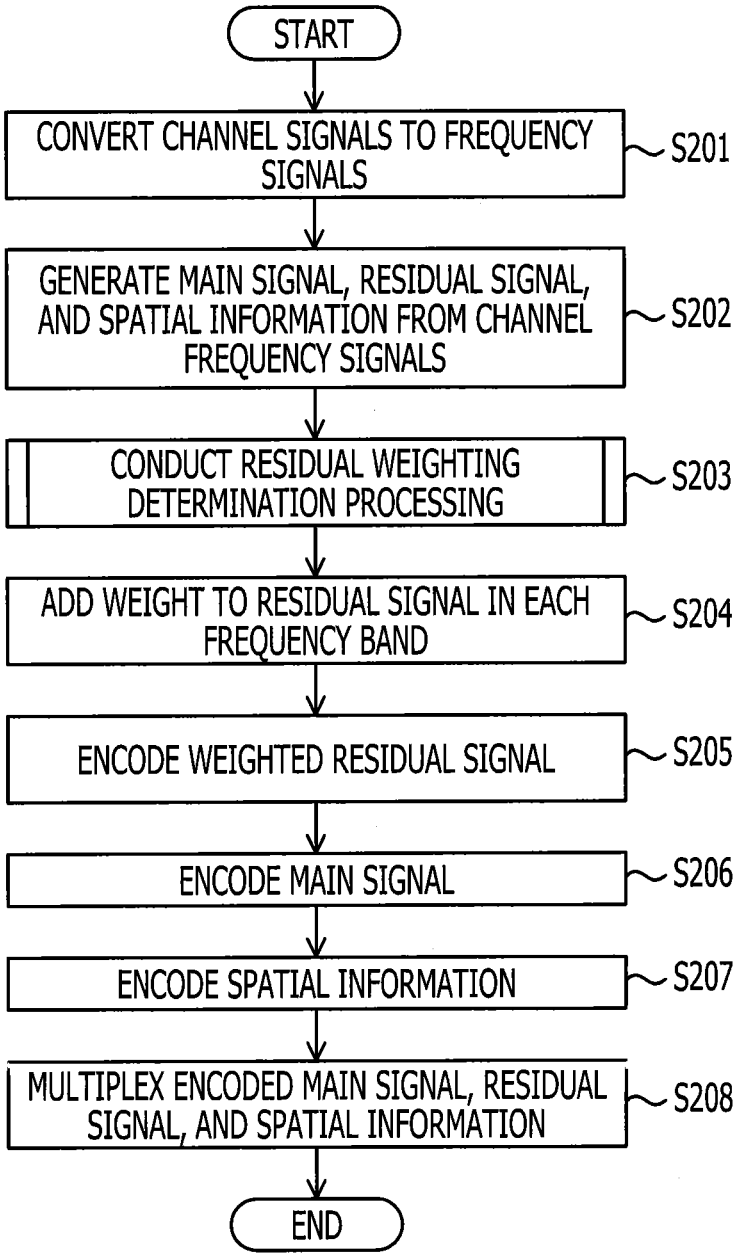
FIG. 11 is a flow chart of audio encoding processing.

FIG. 11 is a flow chart of audio encoding processing. The flow chart illustrated in FIG. 11 describes processing a stereo signal of one frame. The audio encoding device 1 repeatedly conducts the audio encoding processing described in FIG. 11 for each frame while continuing to receive stereo signals.

The time frequency converting unit 11 converts a signal from each channel to a frequency signal (step S201). The time frequency converting unit 11 outputs the channel frequency signal to the downmixing unit 12 and the weight determining unit 13.

The downmixing unit 12 generates a main signal and a residual signal by downmixing the channel frequency signal. The downmixing unit 12 also calculates the spatial information (step S202). The downmixing unit 12 outputs the main signal to the main signal encoding unit 15. The downmixing unit 12 also outputs the residual signal to the weighting unit 14. The downmixing unit 12 outputs the spatial information to the spatial information encoding unit 17. The downmixing unit 12 outputs the main signal, the residual signal, and the spatial information to the weight determining unit 13.

The weight determining unit 13 conducts the residual signal weight determination processing (step S203). As a result, a weighting coefficient in each frequency band with respect to the residual signal is determined. The weight determining unit 13 then outputs the frequency band weighting coefficient to the weighting unit 14.

The weighting unit 14 conducts weighting of the residual signal by multiplying the weighting coefficient by the residual signal in each frequency band (step S204). The weighting unit 14 outputs the weighted residual signal to the residual signal encoding unit 16. The residual signal encoding unit 16 encodes the weighted residual signal (step S205). The residual signal encoding unit 16 outputs the encoded residual signal to the multiplexing unit 18.

The main signal encoding unit 15 encodes the main signal (step S206). The main signal encoding unit 15 outputs the encoded main signal to the multiplexing unit 18. Furthermore, the spatial information encoding unit 17 encodes the spatial information (step S207). The spatial information encoding unit 17 outputs the encoded spatial information to the multiplexing unit 18.

Finally, the multiplexing unit 18 generates an encoded audio signal by multiplexing the encoded main signal, residual signal, and spatial information (step S208).

The multiplexing unit 18 then outputs an encoded audio signal. The audio encoding device 1 then completes the encoding processing.

The audio encoding device 1 may change the implementation order of the processing in steps S203 to S205, the processing in step S206, and the processing in step S207. Alternatively, the audio encoding device 1 may implement the processing in steps S203 to S205, the processing in step S206, and the processing in step S207 in parallel.

Figure 12A:
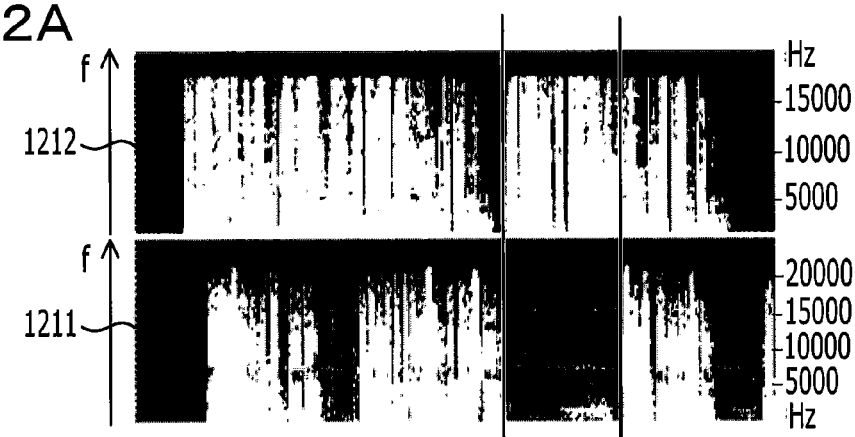
FIG. 12A illustrates an example of left and right channel signals of original stereo signals.
Figure 12B:
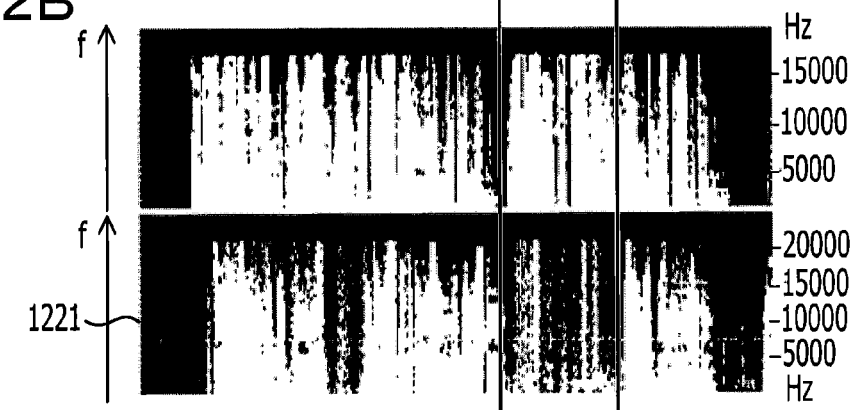
FIG. 12B illustrates an example of a signal reproduced from a stereo signal of the original signal illustrated in FIG. 12A that is encoded with a conventional technique.
Figure 12C:
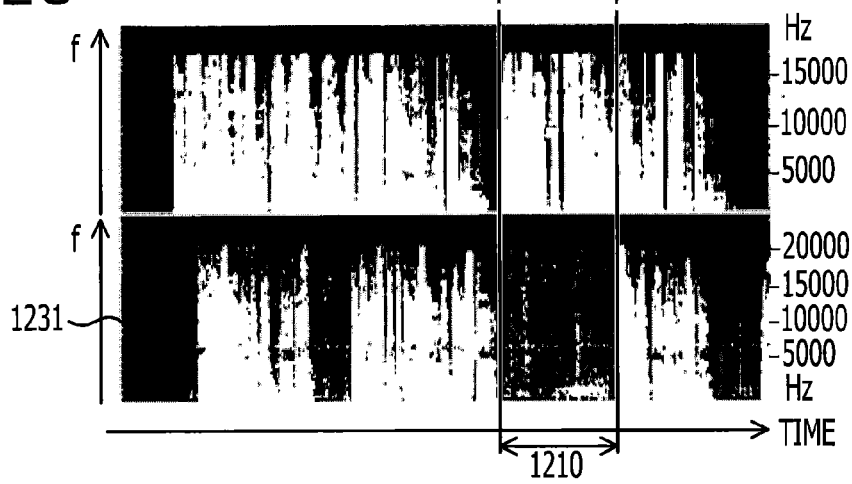
FIG. 12C illustrates an example of a signal reproduced from a stereo signal of the original signal illustrated in FIG. 12A that is encoded with an audio encoding device according to the embodiments discussed herein.

FIG. 12A illustrates an example of left and right channel signals of an original stereo signal. FIG. 12B illustrates an example of a signal reproduced from an encoded stereo signal of the original signal encoded with a conventional technique without conducting weighting of the residual signal. FIG. 12C illustrates an example of a reproduced signal of a stereo signal encoded by the audio encoding device 1 according to the present embodiment.

In FIGS. 12A to 12C, the upper sides represent left channels and the lower sides represent right channels. The horizontal axis represents time and the vertical axis represents frequency. Bright lines represent the signal intensity of each channel such that brighter lines correspond to greater intensities.

As illustrated in FIG. 12A, the original stereo signal exhibits in the time band 1210 a certain level of intensity in the right channel signal 1212 whereas the left channel signal 1211 is almost zero. As illustrated in FIG. 12B, the intensity of the right channel signal 1221 in the time band 1210 is more intense than the original signal 1211 among the reproduced signals of the stereo signal encoded according to the prior art. As a result, the sound quality of the reproduced sound is deteriorated.

Conversely, as illustrated in FIG. 12C, the right channel signal 1231 of the signal reproduced from the stereo signal encoded by the audio encoding device 1 according to the present embodiment is substantially the same as the original right channel signal 1211. The right channel signal in the time band 1210 is also substantially zero. As a result, the quality of the reproduced sound in this case is better than the quality of the reproduced sound of the signals depicted in FIG. 12B. In this way, it may be seen that the original stereo signal may be desirably reproduced by decoding the stereo signal encoded by the audio encoding device 1.

As described above, the audio encoding device determines a weighting coefficient to multiply by the residual signal according to a component included in the residual signal in each frequency band. As a result, the audio encoding device may increase the code size assigned to the residual signal when a large component, such as a contaminating signal, is included in the residual signal affecting the reproduced sound quality and causing a mutual effect between two downmixed channels having a small signal intensity. Conversely, when only a component having a small effect on the reproduced sound quality is included in the residual signal, the audio encoding device may reduce the code size assigned to the residual signal. As a result, the audio encoding device suppresses the deterioration of the reproduced sound quality while reducing the residual signal code size.

However, the present disclosure is not limited to the above embodiment. For example, according to an alternative embodiment, the audio encoding device may calculate the deterioration level NMR(k) and the similarity ICC(k) in time slot units. As a result, the audio encoding device may control the code size assigned to the residual signal with more precision since the weighting coefficient Wm(k) corresponding to a residual signal including a contaminating signal, and the weighting coefficient Wq(k) corresponding to a residual signal not including a contaminating signal may be determined in time slot units.

Also, according to another alternative embodiment, the audio signal subject to encoding is not limited to a stereo signal. For example, the audio signal subject to encoding may be a multi-channel audio signal having three or more channels such as 3 channels, 3.1 channels, 5.1 channels, and 7.1 channels.

Figure 13:
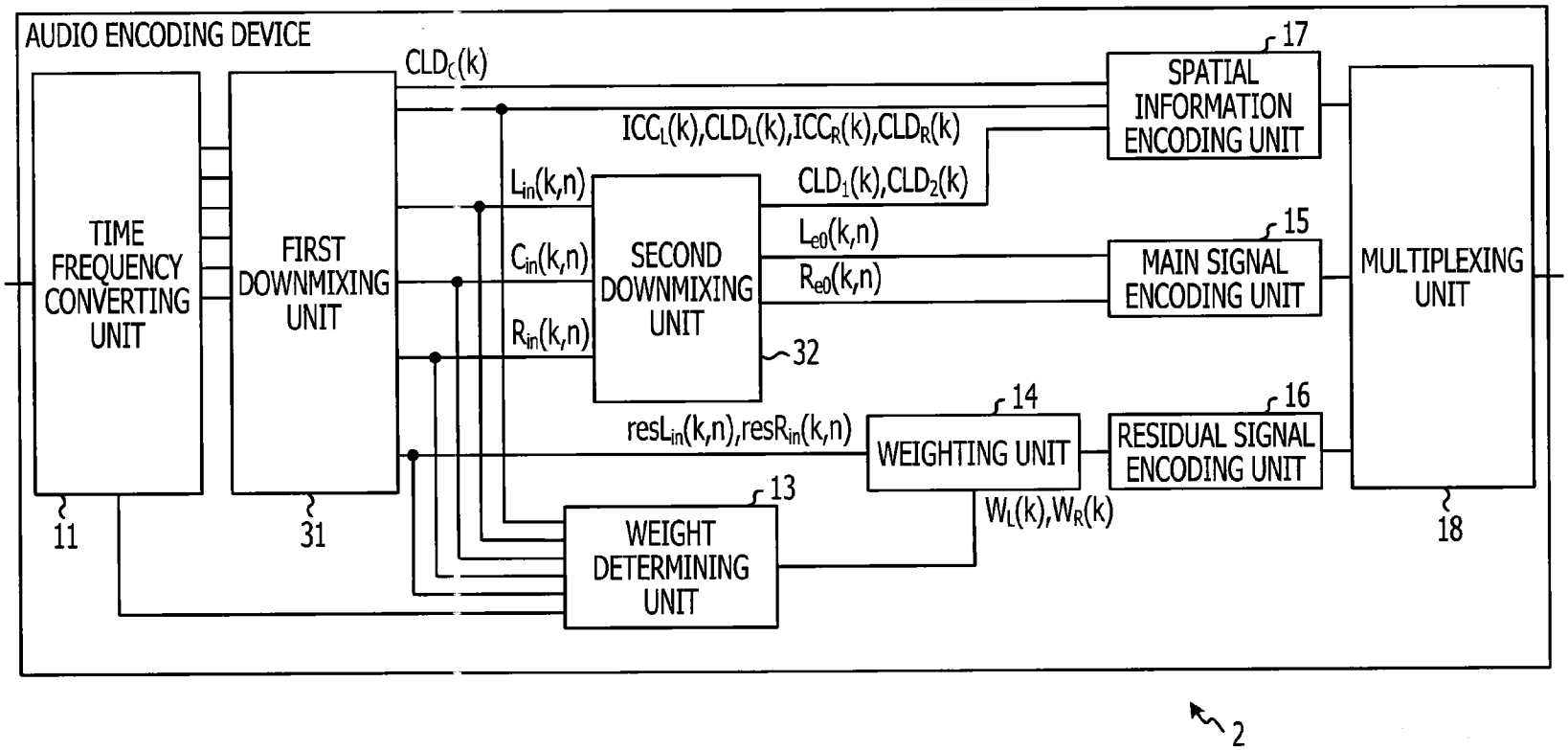
FIG. 13 is a schematic configuration of an audio encoding device according to a second embodiment.

FIG. 13 is a schematic configuration of an audio encoding device according to a second embodiment. The audio encoding device according to the second embodiment generates a stereo signal and spatial information by downmixing a 5.1 ch multi-channel audio signal, and then encodes the stereo signal and the spatial information. The audio encoding device also generates a residual signal when downmixing the 5.1 ch signal and encodes the residual signal after conducting weighting according to the components included in the residual signal. An audio encoding device 2 includes a time frequency converting unit 11, a first downmixing unit 31, a second downmixing unit 32, a weight determining unit 13, a weighting unit 14, a main signal encoding unit 15, a residual signal encoding unit 16, a spatial information encoding unit 17, and a multiplexing unit 18. The constituent elements of the audio encoding device 2 illustrated in FIG. 13 that are similar to the constituent elements corresponding to the audio encoding device 1 illustrated in FIG. 1 are provided with the same reference numerals. The following describes points of the audio encoding device 2 that are different from the audio encoding device 1.

The time frequency converting unit 11 generates a frequency signal of each channel by conducting time-frequency conversion in frame units. The time frequency converting unit 11 outputs the frequency signal of each channel to the first downmixing unit 31.

The first downmixing unit 31 generates main signals, residual signals, and spatial information of the left, center, and right channels by downmixing the 5.1 ch channel frequency signals. For example, the first downmixing unit 31 obtains a similarity $ICC_L(k)$ and an intensity difference $CLD_L(k)$ between the left front channel and the left back channel by substituting the frequency signals of the left front channel and the left back channel for the frequency signals of the left and right channels in Formula (2). The first downmixing unit 31 then obtains a coefficient matrix $M(CLD_L(k), ICC_L(k))$ by respectively substituting the $ICC_L(k)$ and the $CLD_L(k)$ for the ICC(k) and the intensity difference CLD(k) in formula (3). The first downmixing unit 31 further obtains the main signal $L_{in}(k,n)$ and the residual signal $resL_{in}(k,n)$ of the left channel by multiplying the coefficient matrix $M(CLD_L(k), ICC_L(k))$ by a vector that makes up the frequency signal of the left front channel and the left back channel in place of the frequency signals of the left and right channels in Formula (4). Similarly, the first downmixing unit 31 obtains the main signal $R_{in}(k,n)$ and the residual signal $resR_{in}(k,n)$ of the right channel, and obtains the similarity $ICC_R(k)$ and the intensity difference $CLD_R(k)$ between the right front channel and the right back channel from the frequency signal of the right front channel and the frequency signal of the right back channel.

Furthermore, the first downmixing unit 31 calculates the intensity difference $CLD_C(k)$ and the main signal $C_{in}(k,n)$ between the frequency signals of the base channel and the frequency signals of the central channel according to the following formula. The first downmixing unit 31 does not calculate the similarity or the residual signal between the central channel and the base channel.

$$CLD_c(k) = 10\log_{10}\left(\frac{e_c(k)}{e_{LFE}(k)}\right) \tag{6}$$

$$e_c(k) = \sum_{n=0}^{N-1} |C(k, n)|^2$$

-continued $$e_{LFE}(k) = \sum_{n=0}^{N-1} |LFE(k, n)|^2$$

$$C_{in}(k, n) = C_{inRe}(k, n) + j \cdot C_{inIm}(k, n)$$

$$C_{inRe}(k, n) = C_{Re}(k, n) + LFE_{Re}(k, n)$$

$$C_{inIm}(k, n) = C_{Im}(k, n) + LFE_{Im}(k, n)$$

Here, $C_{Re}(k,n)$ represents a real part of the central channel frequency signal C(k,n) and $C_{Im}(k,n)$ represents an imaginary part of the central channel frequency signal C(k,n). $LFE_{Re}(k,n)$ represents a real part of the base channel frequency signal LFE(k,n) and $LFE_{Im}(k,n)$ represents an imaginary part of the base channel frequency signal LFE(k,n). $C_{in}(k,n)$ is the main signal of the central channel generated by the downmixing. $C_{inRe}(k,n)$ represents a real part of the central channel main signal $C_{in}(k,n)$ and $C_{inIm}(k,n)$ represents an imaginary part of the central channel main signal $C_{in}(k,n)$. Moreover, $e_C(k)$ is an auto-correlation value of the central channel frequency signal C(k,n), and $e_{LFE}(k)$ is an auto-correlation value of the base channel frequency signal LFE(k,n).

The first downmixing unit 31 outputs the main signal, the residual signal, and the spatial information of the right channel to the weight determining unit 13. The first downmixing unit 31 outputs the main signal, the residual signal, and the spatial information of the left channel to the weight determining unit 13. The first downmixing unit 31 also outputs the main signals of the left channel, the right channel, and the central channel to the second downmixing unit 32. The first downmixing unit 31 also outputs the residual signals of the left channel and the right channel to the weighting unit 14. The first downmixing unit 31 outputs the spatial information of the right channel and the central channel to the spatial information encoding unit 17.

The second downmixing unit 32 generates a 2-channel stereo frequency signal by downmixing two of the main signals among the three main signals from the right, left, and central channels. The second downmixing unit 32 also generates spatial information of the two downmixed frequency signals.

The second downmixing unit 32 generates a left side frequency signal $L_{e0}(k,n)$ and a right side frequency signal $R_{e0}(k,n)$ of the stereo frequency signals using, for example, the following formula.

$$\begin{pmatrix} L_{e0}(k, n) \\ R_{e0}(k, n) \end{pmatrix} = \begin{pmatrix} 1 & 0 & \frac{\sqrt{2}}{2} \\ 0 & 1 & \frac{\sqrt{2}}{2} \end{pmatrix} \begin{pmatrix} L_{in}(k, n) \\ R_{in}(k, n) \\ C_{in}(k, n) \end{pmatrix} \tag{7}$$

Here, $L_{in}(k,n)$, $R_{in}(k,n)$, and $C_{in}(k,n)$ are the respective left channel, right channel, and central channel main signals generated by the first downmixing unit 31.

The second downmixing unit 32 also calculates spatial information of the two downmixed frequency signals using, for example, a so-called energy mode. Specifically, the second downmixing unit 32 uses the following formula to calculate a signal power ratio $CLD_1(k)$ of the left and right channels with respect to the central channel, and a signal power ratio $CLD_2(k)$ between the left and right channels for each frequency band as spatial information.

$$CLD_1(k) = 10\log_{10}\left(\frac{e_{L_{in}}(k) + e_{R_{in}}(k)}{e_{C_{in}}(k)}\right) \tag{8}$$

$$CLD_2(k) = 10\log_{10}\left(\frac{e_{L_{in}}(k)}{e_{R_{in}}(k)}\right)$$

$$e_{L_{in}}(k) = \sum_{n=0}^{N-1} |L_{in}(k, n)|^2$$

$$e_{R_{in}}(k) = \sum_{n=0}^{N-1} |R_{in}(k, n)|^2$$

$$e_{C_{in}}(k) = \sum_{n=0}^{N-1} |C_{in}(k, n)|^2$$

Here, $e_{Lin}(k)$ is an auto-correlation value of the left channel frequency signal $L_{in}(k,n)$ in the frequency band k. $e_{Rin}(k)$ is an auto-correlation value of the right channel frequency signal $R_{in}(k,n)$ in the frequency band k. $e_{Cin}(k)$ is an auto-correlation value of the central channel frequency signal $C_{in}(k,n)$ in the frequency band k.

As another spatial information calculating method, the second downmixing unit 32 may calculate spatial information of the two downmixed frequency signals using, for example, a so-called prediction mode.

The second downmixing unit 32 outputs the stereo frequency signals $L_{e0}(k,n)$ and $R_{e0}(k,n)$ to the main signal encoding unit 15. The second downmixing unit 32 outputs the spatial information $CLD_1(k)$ and $CLD_2(k)$ to the spatial information encoding unit 17.

The weight determining unit 13 has a similar function as the weight determining unit according to the first embodiment. The weight determining unit 13 conducts processing similar to the processing conducted by the weight determining unit of the first embodiment to determine a weighting coefficient $W_L(k)$ for the left channel residual signal in each frequency band based on the left channel main signal, the residual signal, and the spatial information. Similarly, the weight determining unit 13 conducts processing similar to the processing conducted by the weight determining unit of the first embodiment to determine a weighting coefficient $W_R(k)$ for the right channel residual signal in each frequency band based on the right channel main signal, the residual signal, and the spatial information. The weight determining unit 13 outputs the left channel weighting coefficient $W_L(k)$ and the right channel $W_R(k)$ to the weighting unit 14.

The weighting unit 14 adds weight to the left channel residual signal by multiplying the left channel residual signal $resL_{in}(k,n)$ by the weighting coefficient $W_L(k)$ for each frequency band in the same way as the weighting unit according to the first embodiment. Similarly, the weighting unit 14 adds weight to the right channel residual signal by multiplying the right channel residual signal $resR_{in}(k,n)$ by the weighting coefficient $W_R(k)$ for each frequency band.

The weighting unit 14 outputs the weighted left channel and right channel residual signals to the residual signal encoding unit 16.

The main signal encoding unit 15 encodes the stereo frequency signals $L_{e0}(k,n)$ and $R_{e0}(k,n)$ by conducting similar processing as the main signal encoding unit of the first embodiment on the stereo frequency signals $L_{e0}(k,n)$ and $R_{e0}(k,n)$. Therefore, the main signal encoding unit 15 conducts, for example, AAC encoding on the low-frequency components of the stereo frequency signals $L_{e0}(k,n)$ and $R_{e0}(k,n)$, and conducts SBR encoding on the high-frequency components of the stereo frequency signals $L_{e0}(k,n)$ and $R_{e0}(k,n)$. The main signal encoding unit 15 outputs the encoded main signals $L_{e0}(k,n)$ and $R_{e0}(k,n)$ to the multiplexing unit 18.

The residual signal encoding unit 16 encodes the left channel residual signal and the right channel residual signal by conducting the same processing as the residual signal encoding unit of the first embodiment on the weighted left channel and right channel residual signals. As a result, for example, the left channel residual signal and the right channel residual signal are each AAC-encoded. The residual signal encoding unit 16 outputs the encoded left and right channel residual signals to the multiplexing unit 18.

The spatial information encoding unit 17 generates an MPEG Surround code (hereinbelow, referred to as MPS code) by conducting the same processing as the spatial information spatial information encoding unit of the first embodiment on the spatial information. The spatial information encoding unit 17 outputs the MPS code to the multiplexing unit 18.

The multiplexing unit 18 conducts multiplexing by arranging the encoded main signal, residual signal, and spatial information in the certain order according to, for example, the MPEG-4 ADTS format described in FIG. 10. The multiplexing unit 18 outputs the encoded audio signal generated by the above multiplexing.

In this way, the audio encoding device according to the second embodiment determines a weighting coefficient for a residual signal generated when downmixing the 5.1 ch audio signal depending upon whether or not a contaminating signal is included in the residual signal. As a result, the audio encoding device suppresses the deterioration of the reproduced sound quality while reducing the residual signal code size.

Moreover, according to another alternative embodiment, a weight determining unit may extract components other than contaminating signals that mutually affect each other between two downmixed channels in each frequency band, and determine a weighting coefficient for a residual signal according to those components. For example, by downmixing signals of two channels, the frequency signals of the two channels may cancel each other out and the main signal may be attenuated. In this case, a muffled sound is generated when reproducing the encoded audio signals. In the alternative embodiment, the weight determining unit detects a component corresponding to the muffled sound included in the residual signal in each frequency band and establishes a weighting coefficient with respect to the component with a separate contamination weight and a separate quantization error weight.

Figure 14:
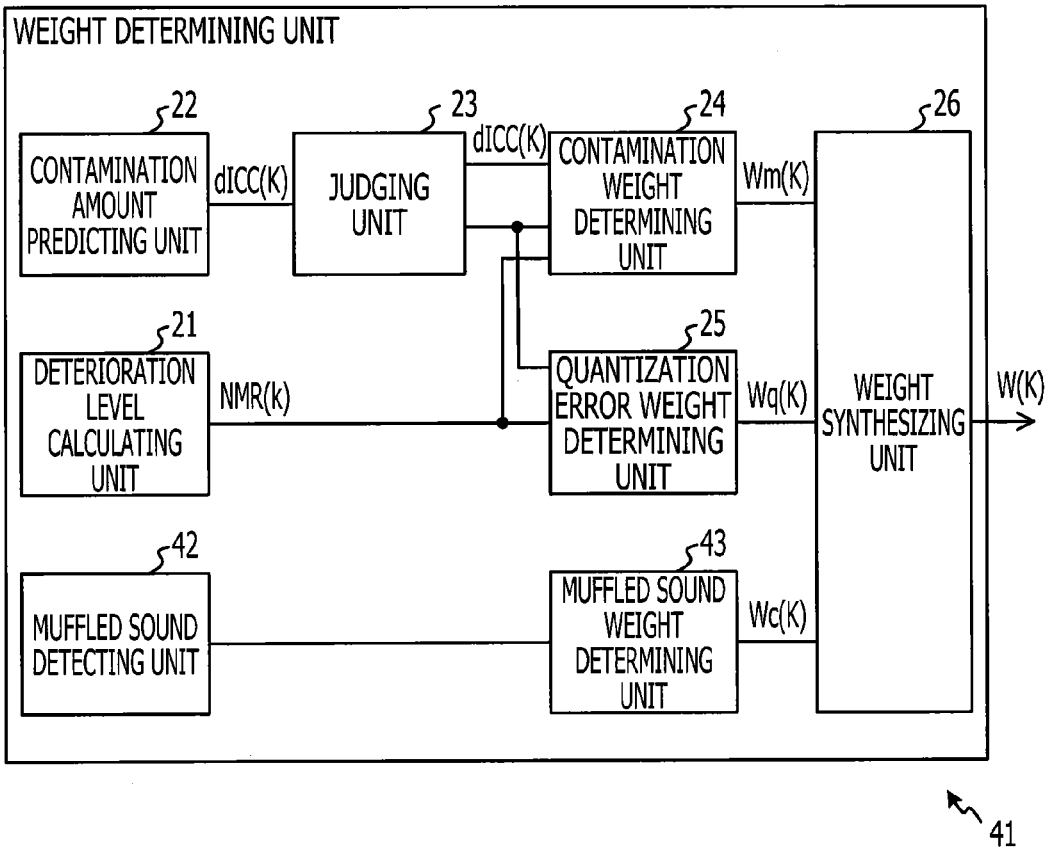
FIG. 14 is a schematic configuration of a weight determining unit according to an alternative embodiment of the audio encoding device according to any one of the embodiments discussed herein.

FIG. 14 is a schematic configuration of a weight determining unit according to an alternative embodiment of an audio encoding device according to any one of the embodiments discussed herein. As illustrated in FIG. 14, a weight determining unit 41 includes a deterioration level calculating unit 21, a contamination amount predicting unit 22, a judging unit 23, a contamination weight determining unit 24, a quantization error weight determining unit 25, a weight synthesizing unit 26, a muffled sound detecting unit 42, and a muffled sound weight determining unit 43.

The constituent elements other than the weight determining units of the audio encoding device may be referred to in the descriptions of the first and second embodiments. The constituent elements in the weight determining unit 41 other than the muffled sound detecting unit 42, the muffled sound weight determining unit 43, and the weight synthesizing unit 26 are similar to the corresponding constituent elements of the weight determining unit 13 according to the first embodiment. The following is an explanation of the muffled sound detecting unit 42, the muffled sound weight determining unit 43, and the weight synthesizing unit 26. Moreover, the explanation will describe the weight determining unit 41 setting the weighting coefficients for residual signals derived from a left channel signal and a right channel signal included in a stereo signal.

The muffled sound detecting unit 42 detects a component corresponding to a muffled sound included in the residual signal of each frequency band.

Since the main signal is attenuated when the sound of an audio signal reproduced from an encoded audio signal sounds muffled, the frequency signals of the channels reproduced from the main signal are more attenuated than the original frequency signals.

Thus, the muffled sound detecting unit 42 predicts a decoding value of, for example, the left channel and right channel frequency signals from the main signal and the spatial information. The muffled sound detecting unit 42 obtains an attenuation amount $\Delta_L(k)$ by subtracting the original left channel power from the power of the left channel predicted decoding value (corresponding to $e_L(k)$ from formula (2)) for each frequency band. Similarly, the muffled sound detecting unit 42 then obtains an attenuation amount $\Delta_R(k)$ by subtracting the original right channel power from the power of the right channel predicted decoding value (corresponding to $e_R(k)$ in formula (2)) for each frequency band. The muffled sound detecting unit 42 establishes the larger value between the $\Delta_L(k)$ and the $\Delta_R(k)$ as a muffled sound attenuation amount $\Delta(k)$ included in the residual signal. If the muffled sound attenuation amount $\Delta(k)$ in the frequency band k is equal to or greater than a certain threshold Thc, the muffled sound detecting unit 42 determines that a muffled sound is included in the residual signal in the frequency band k. The certain threshold Thc is set, for example, to 1/10 to 1/2 of the power of the largest of the original left channel and right channel powers.

The muffled sound detecting unit 42 may predict decoding values of the left and right channel frequency signals according to, for example, the decoded sound prediction method described in section 6.5.3.2 of ISO/IEC23003-1 in the same way as the contamination amount predicting unit 22. Alternatively, the muffled sound detecting unit 42 may predict decoding values of the left and right channel frequency signals according to, for example, the decoded sound prediction method disclosed in Japanese Laid-Open Patent Publication No. 2010-139671.

The muffled sound detecting unit 42 reports the frequency band determined to include a muffled sound and the attenuation amount $\Delta(k)$ to the muffled sound weight determining unit 43.

The muffled sound weight determining unit 43 determines a weighting coefficient Wc(k) to multiply by the residual signal for each frequency band determined to include a muffled sound such that the weighting coefficient Wc(k) increases as the muffled sound attenuation amount $\Delta(k)$ increases. Conversely, the muffled sound weight determining unit 43 determines a weighting coefficient Wc(k) of zero for each frequency band determined to not include a muffled sound. The muffled sound weight determining unit 43 may also set the weighting coefficient Wc(k) to zero for a frequency band in which the deterioration level NMR(k) is not greater than zero. However, the weighting coefficient Wc(k) is preferably set to a value larger than the weighting coefficient Wq(k) of the quantization error for the residual signal at the same level. The muffled sound weight determining unit 43 outputs the frequency band weighting coefficients Wc(k) to the weight synthesizing unit 26.

The weight synthesizing unit 26 obtains the weighting coefficient W(k) for each frequency band by adding the weighting coefficient Wm(k) when a contaminating signal is included in the residual signal, the weighting coefficient Wq(k) when no contaminating signal is included in the residual signal, and the weighting coefficient Wc(k) when a component corresponding to a muffled sound is included in the residual signal. The weight synthesizing unit 26 outputs the weighting coefficient W(k) to the weighting unit.

According to this alternative embodiment, the audio encoding device is able to increase the code size assigned to the residual signal even for a muffled sound by reproducing an encoded audio signal without using the residual signal. Therefore, the audio encoding device may suppress muffled sound in a reproduced audio signal.

A computer program that causes a computer implement the functions of each unit in the audio encoding device according to the above embodiments may be provided by being stored in a semiconductor memory or in a recording medium such as a magnetic or optical recording medium.

The audio encoding device according to the above embodiments may also be mounted in various types of devices used for transmitting or recording audio signals such as a computer, a video signal recorder, or a video transmitter.

Figure 15:
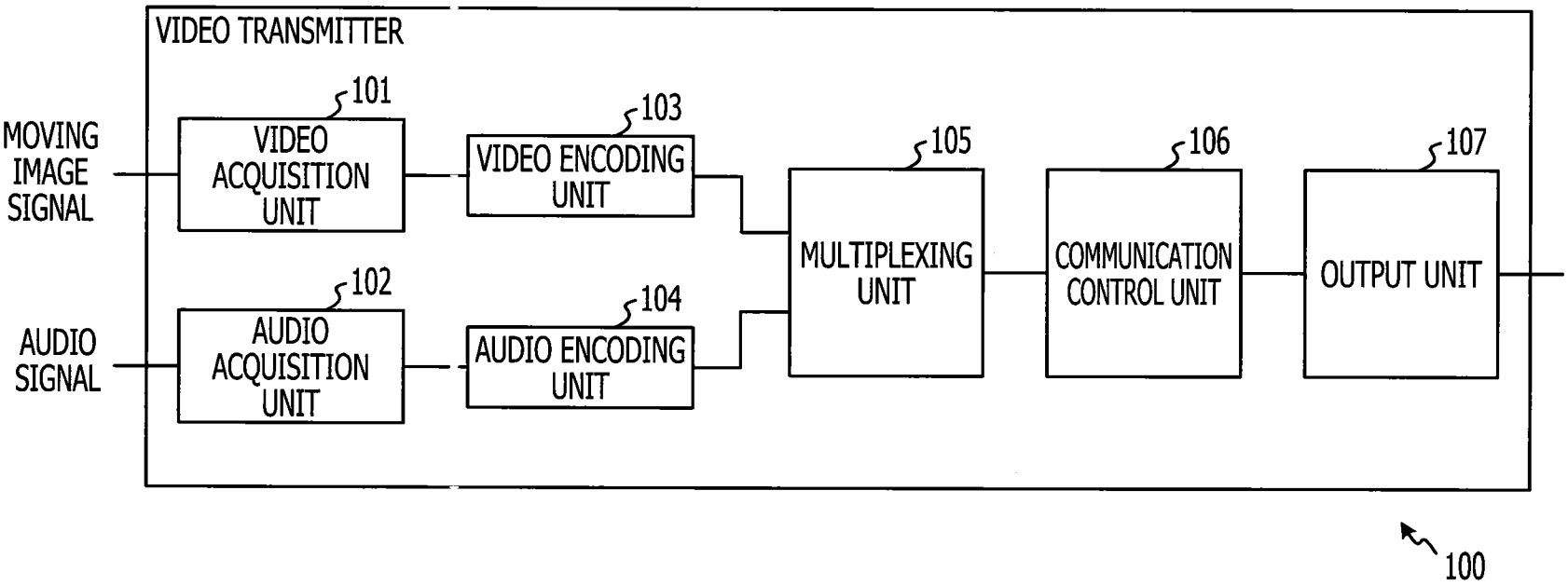
FIG. 15 is a schematic configuration of a video transmission device having the audio encoding device according to any one of the embodiments discussed herein.

FIG. 15 is a schematic configuration of a video transmission device having the audio encoding device according to an alternative embodiment or any one of the embodiments described above. A video transmitter 100 includes a video acquisition unit 101, an audio acquisition unit 102, a video encoding unit 103, an audio encoding unit 104, a multiplexing unit 105, and communication control unit 106, and an output unit 107.

The video acquisition unit 101 has an interface circuit for acquiring a moving image signal from another device such as a video camera and the like. The video acquisition unit 101 transfers the moving image signal inputted into the video transmitter 100 to the video encoding unit 103.

The audio acquisition unit 102 has an interface circuit for acquiring an audio signal from another device such as a microphone and the like. The audio acquisition unit 102 transfers the audio signal inputted into the video transmitter 100 to the audio encoding unit 104.

The video encoding unit 103 encodes the moving image signal so as to compress the data size of the moving image signal. The video encoding unit 103 encodes the moving image signal according to a moving image encoding standard such as, for example, MPEG-2, MPEG-4, or H.264 MPEG-4 Advanced Video Coding (H.264 MPEG-4 AVC). The video encoding unit 103 outputs the encoded moving image signal to the multiplexing unit 105.

The audio encoding unit 104 includes an audio encoding device according to any one of the above embodiments. The audio encoding unit 104 generates a main signal, a residual signal, and spatial information from the audio signal. The audio encoding unit 104 encodes the main signal using the AAC encoding process and the SBR encoding process. The audio encoding unit 104 encodes the spatial information using a spatial information encoding process. The audio encoding unit 104 also adds a weight to the residual signal according to a component included in the residual signal, and then encodes the weighted residual signal using, for example, AAC encoding. The audio encoding unit 104 generates encoded audio data by multiplexing the encoded main signal, residual signal, and spatial information. The audio encoding unit 104 outputs the encoded audio data to the multiplexing unit 105.

The multiplexing unit 105 multiplexes the encoded moving image data and the encoded audio data. The multiplexing unit 105 generates a stream compliant with a certain format for transmitting video data such as an MPEG-2 transport stream and the like.

The multiplexing unit 105 outputs the stream in which the encoded moving image data and the encoded audio data are multiplexed to the communication control unit 106.

The communication control unit 106 divides the stream in which the encoded moving image data and the encoded audio data are multiplexed into packets compliant with a certain communication standard such as TCP/IP and the like. The communication control unit 106 adds a certain header in which destination information and the like are stored to each packet. The communication control unit 106 then transfers the packets to the output unit 107.

The output unit 107 has an interface circuit for connecting the video transmitter 100 to a communication line. The output unit 107 outputs the packets received from the communication control unit 106 to the communication line.

Figure 16:
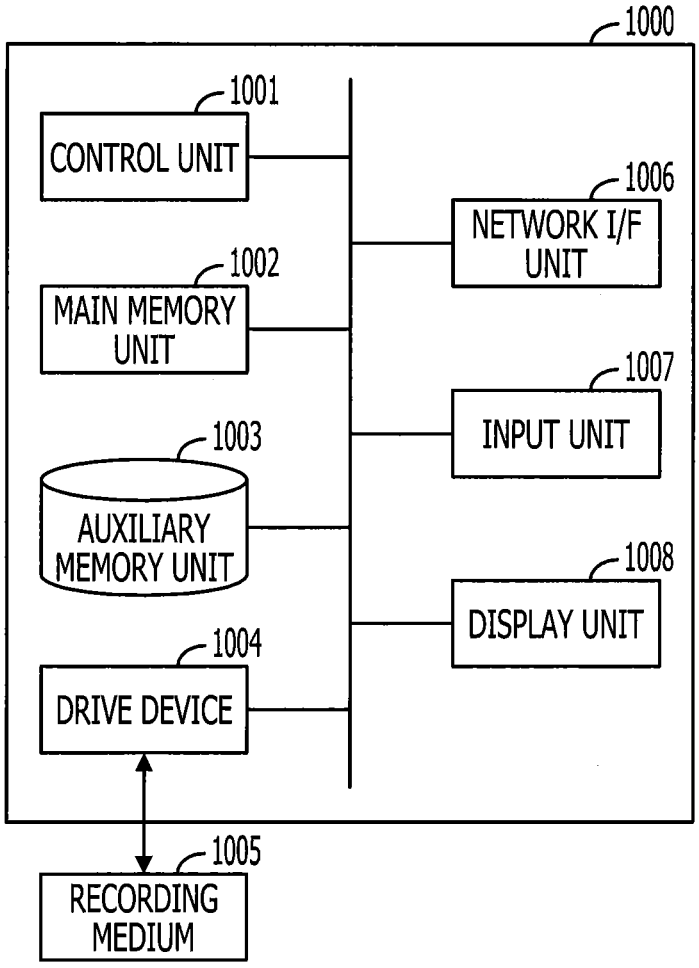
FIG. 16 is an example of a configuration of an audio encoding device.

FIG. 16 is an example of a configuration of an audio encoding device 1000. As illustrated in FIG. 16, the audio encoding device 1000 includes a control unit 1001, a main memory unit 1002, an auxiliary memory unit 1003, a drive device 1004, a network I/F unit 1006, an input unit 1007, and a display unit 1008. The above components are interconnected to allow for the sending and receiving of data through a bus.

The control unit 1001 is a CPU that controls the devices, computes data, and conducts processing in a computer. The control unit 1001 is a computing device that executes programs stored in the main memory unit 1002 and the auxiliary memory unit 1003, receives, computes, and processes data from the input unit 1007 and a storage device, and then outputs the data to the display unit 1008, the storage devices, and the like.

The main memory unit 1002 is a storage device, such as Read Only Memory (ROM) or Random Access Memory (RAM) and the like, that stores or temporarily saves an OS that is basic software operated by the control unit 1001, programs such as application software, and data.

The auxiliary memory unit 1003 is a storage device, such as a Hard Disk Drive (HDD) and the like, that stores data related to the application software and the like.

The drive device 1004 reads a program from a recording medium 1005 such as a flexible disk and the like, and installs the program in the storage devices.

Certain programs are stored in the recording medium 1005, and the programs stored in the recording medium 1005 are installed in the audio encoding device 1000 via the drive device 1004. The installed certain programs may be executed by the audio encoding device 1000.

The network I/F unit 1006 is an interface between the audio encoding device 1000 and a periphery device having a communication function connected to a network such as a Local Area Network (LAN) or a Wide Area Network (WAN) made up of data transmission lines such as wired and/or wireless lines.

The input unit 1007 includes a keyboard equipped with a cursor key, a numerical input, and various keys and the like, and a mouse or slide pad for selecting a key on a display screen of the display unit 1008. The input unit 1007 is also a user interface for a user to provide operating instructions to the control unit 1001 and for inputting data.

The display unit 1008 is configured of a Cathode Ray Tube (CRT) or a Liquid Crystal Display (LCD) and the like, and provides a display according to display data inputted from the control unit 1001.

In this way, the audio encoding processing described in the abovementioned embodiments may be implemented as a program for executing a computer. The abovementioned video encoding processing may be implemented by installing the program from a server and the like to cause the computer to be executed.

Moreover, the abovementioned video encoding processing may be implemented by recording the program in the recording medium 1005 and causing a computer or a mobile terminal to read the program from the recording medium 1005 in which the program is recorded. The recording medium 1005 may be various types of recording media such as a recording medium in which information is optically, electrically or magnetically recorded such as a CD-ROM, a flexible disk, or an optical magnetic disc, or a semiconductor memory in which information is electrically recorded such as a ROM or a flash memory. Additionally, the audio encoding processing described in the above-mentioned embodiments may be implemented by one or a plurality of integrated circuits.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio encoding device comprising:

a processor; and a memory that stores a plurality of instructions, which when executed by the processor cause the processor to execute, a time-frequency converting instruction that conducts time-frequency conversion of channel signals included in an audio signal having a plurality of channels in frame units having a certain length of time to convert the channel signals to respective frequency signals;

a downmixing instruction that generates a main signal representing a major component of a first channel and a second channel among the plurality of channels, and a residual signal that is a component orthogonal to the main signal by downmixing a frequency signal of the first channel and a frequency signal of the second channel;

a weight determining instruction that obtains a decoding value predicted from the frequency signal of the first channel and a decoding value predicted from the frequency signal of the second channel, obtains signal components affecting each other between the first channel and the second channel in the residual signal based on the decoding value of the first channel and the decoding value of the second channel, and determines a weighting coefficient with respect to the residual signal according to the signal components;

a weighting instruction that uses the weighting coefficient to add weight to the residual signal;

a residual signal encoding instruction that encodes the weighted residual signal the weighting coefficient; and a main signal encoding instruction that encodes the main signal.

2. The device according to claim 1, wherein the downmixing instruction calculates a similarity between the frequency signal of the first channel and the frequency signal of the second channel across a plurality of frequency bands, and calculates the residual signal across the plurality of frequency bands; and wherein the weight determining instruction calculates a post-encoding similarity between the decoding value of the first channel and the decoding value of the second channel across the plurality of frequency bands, and judges, among the plurality of frequency bands, that the residual signal includes the signal component in a frequency band in which the post-encoding similarity increases more than the similarity, and makes a weighting coefficient with respect to the residual signal in the frequency band that includes the signal component larger than a weighting coefficient with respect to a residual signal in a frequency band that does not include the signal component.

3. The device according to claim 2, wherein the weight determining instruction correspondingly increases the weighting coefficient with respect to the residual signal in the frequency band that includes the signal component in relation to an increase in the size of a difference between the post-encoding similarity and the similarity.

4. The device according to claim 2, wherein the weight determining instruction obtains, in the respective plurality of frequency bands, a difference between the residual signal and a masking threshold representing a lower limit of a signal strength that a listener is able to hear, and correspondingly increases the weighting coefficient with respect to the residual signal in the frequency band that does not include the signal component in relation to an increase in the size of a difference between the residual signal and the masking threshold.

5. The device according to claim 4, wherein the weight determining instruction sets to zero the weighting coefficient with respect to a frequency band in which the difference between the residual signal and the masking threshold is not greater than zero.

6. The device according to claim 1, wherein the downmixing instruction calculates the residual signal across a plurality of frequency bands; and wherein the weight determining instruction judges, among the plurality of frequency bands, that the residual signal includes the signal component in a frequency band in which the decoding value of the first channel is larger than the frequency signal of the first channel or the decoding value of the second channel is larger than the frequency signal of the second channel, and makes a weighting coefficient with respect to the residual signal in the frequency band that includes the signal component larger than a weighting coefficient with respect to a residual signal in a frequency band that does not include the signal component.

7. An audio encoding method comprising:

converting channel signals included in an audio signal having a plurality of channels to respective frequency signals by conducting time-frequency conversion of the channel signals in frame units having a certain length of time;

generating a main signal, by a computer processor, representing a major component of a first channel and a second channel among the plurality of channels and a residual signal that is a component orthogonal to the main signal by downmixing a frequency signal of the first channel and a frequency signal of the second channel;

obtaining a decoding value predicted from the frequency signal of the first channel and a decoding value predicted from the frequency signal of the second channel;

determining a weighting coefficient with respect to the residual signal according to signal components affecting each other between the first channel and the second channel in the residual signal by obtaining the signal components based on the decoding value of the first channel and the decoding value of the second channel, and;

adding weight to the residual signal by using the weighting coefficient;

encoding the weighted residual signal; and encoding the main signal.

8. The method according to claim 7, wherein the generating includes calculating a similarity between the frequency signal of the first channel and the frequency signal of the second channel across a plurality of frequency bands, and calculating the residual signal across the plurality of frequency bands; and wherein the determining includes calculating a post-encoding similarity between the decoding value of the first channel and the decoding value of the second channel across the plurality of frequency bands, judging, among the plurality of frequency bands, that the residual signal includes the signal component in a frequency band in which the post-encoding similarity increases more than the similarity, and making a weighting coefficient with respect to the residual signal in the frequency band that includes the signal component larger than a weighting coefficient with respect to a residual signal in a frequency band that does not include the signal component.

9. The method according to claim 8, wherein the determining includes correspondingly increasing the weighting coefficient with respect to the residual signal in the frequency band that includes the signal component in relation to an increase in the size of a difference between the post-encoding similarity and the similarity.

10. The method according to claim 8, wherein, the determining includes obtaining, in the respective plurality of frequency bands, a difference between the residual signal and a masking threshold representing a lower limit of a signal strength that a listener is able to hear, and correspondingly increasing the weighting coefficient with respect to the residual signal in the frequency band that does not include the signal component correspondingly larger in relation to an increase in the size of a difference between the residual signal and the masking threshold.

11. The method according to claim 10, wherein the determining includes setting to zero the weighting coefficient with respect to a frequency band in which the difference between the residual signal and the masking threshold is not greater than zero.

12. The method according to claim 7, wherein the generating includes calculating the residual signal across a plurality of frequency bands; and wherein the determining includes judging, among the plurality of frequency bands, that the residual signal includes the signal component in a frequency band in which the decoding value of the first channel is larger than the frequency signal of the first channel or the decoding value of the second channel is larger than the frequency signal of the second channel, and making a weighting coefficient with respect to the residual signal in the frequency band that includes the signal component larger than a weighting coefficient with respect to a residual signal in a frequency band that does not include the signal component.

13. A computer-readable storage medium storing an audio encoding computer program that causes a computer to execute a process comprising:

converting channel signals included in an audio signal having a plurality of channels to respective frequency signals by conducting time-frequency conversion of the channel signals in frame units having a certain length of time;

generating a main signal, by a computer processor, representing a major component of a first channel and a second channel among the plurality of channels and a residual signal that is a component orthogonal to the main signal by downmixing a frequency signal of the first channel and a frequency signal of the second channel;

obtaining a decoding value predicted from the frequency signal of the first channel and a decoding value predicted from the frequency signal of the second channel;

determining a weighting coefficient with respect to the residual signal according to signal components affecting each other between the first channel and the second channel in the residual signal by obtaining the signal components based on the decoding value of the first channel and the decoding value of the second channel, and;

adding weight to the residual signal by using the weighting coefficient;

encoding the weighted residual signal; and encoding the main signal.

14. The computer-readable storage medium according to claim 13, wherein the generating includes calculating a similarity between the frequency signal of the first channel and the frequency signal of the second channel across a plurality of frequency bands, and calculating the residual signal across the plurality of frequency bands; and wherein the determining includes calculating a post-encoding similarity between the decoding value of the first channel and the decoding value of the second channel across the plurality of frequency bands, judging, among the plurality of frequency bands, that the residual signal includes the signal component in a frequency band in which the post-encoding similarity increases more than the similarity, and making a weighting coefficient with respect to the residual signal in the frequency band that includes the signal component larger than a weighting coefficient with respect to a residual signal in a frequency band that does not include the signal component.

15. The computer-readable storage medium according to claim 14, wherein the determining includes correspondingly increasing the weighting coefficient with respect to the residual signal in the frequency band that includes the signal component in relation to an increase in the size of a difference between the post-encoding similarity and the similarity.

16. The computer-readable storage medium according to claim 14, wherein, the determining includes obtaining, in the respective plurality of frequency bands, a difference between the residual signal and a masking threshold representing a lower limit of a signal strength that a listener is able to hear, and correspondingly increasing the weighting coefficient with respect to the residual signal in the frequency band that does not include the signal component correspondingly larger in relation to an increase in the size of a difference between the residual signal and the masking threshold.

17. The computer-readable storage medium according to claim 16, wherein the determining includes setting to zero the weighting coefficient with respect to a frequency band in which the difference between the residual signal and the masking threshold is not greater than zero.

18. The computer-readable storage medium according to claim 13, wherein the generating includes calculating the residual signal across a plurality of frequency bands; and wherein the determining includes judging, among the plurality of frequency bands, that the residual signal includes the signal component in a frequency band in which the decoding value of the first channel is larger than the frequency signal of the first channel or the decoding value of the second channel is larger than the frequency signal of the second channel, and making a weighting coefficient with respect to the residual signal in the frequency band that includes the signal component larger than a weighting coefficient with respect to a residual signal in a frequency band that does not include the signal component.

* * * * *

UNITED STATES PATENT AND TRADEMARK OFFICE

CERTIFICATE OF CORRECTION

PATENT NO. : 8,831,960 B2
APPLICATION NO. : 13/546292
DATED : September 9, 2014
INVENTOR(S) : Shirakawa et al.

It is certified that error appears in the above-identified patent and that said Letters Patent is hereby corrected as shown below:

In the Claims

Column 28, line 9, claim 13, before “computer-readable” insert -- non-transitory --.

Column 28, line 38, claim 14, before “computer-readable” insert -- non-transitory --.

Column 28, line 57, claim 15, before “computer-readable” insert -- non-transitory --.

Column 28, line 65, claim 16, before “computer-readable” insert -- non-transitory --.

Column 29, line 11, claim 17, before “computer-readable” insert -- non-transitory --.

Column 29, line 17, claim 18, before “computer-readable” insert -- non-transitory --.

Signed and Sealed this
Eighteenth Day of November, 2014

Michelle K. Lee

Michelle K. Lee
*Deputy Director of the United States Patent and Trademark Office*